US006540219B1

(12) United States Patent
Naruse et al.

(10) Patent No.: US 6,540,219 B1
(45) Date of Patent: Apr. 1, 2003

(54) PAPER FEEDING DEVICE

(75) Inventors: Akira Naruse; Kouichi Kumon; Mitsuru Sato, all of Kawasaki (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 09/646,282

(22) PCT Filed: Jan. 19, 2000

(86) PCT No.: PCT/JP00/00227

§ 371 (c)(1),
(2), (4) Date: Oct. 12, 2000

(87) PCT Pub. No.: WO00/43306

PCT Pub. Date: Jul. 27, 2000

(30) Foreign Application Priority Data

Jan. 19, 1999 (JP) ..... 11-009991

(51) Int. Cl.[7] ..... B65H 1/06
(52) U.S. Cl. ..... 271/37; 221/109; 221/121
(58) Field of Search ..... 271/37, 38, 109, 271/121, 126, 157, 165, 167

(56) References Cited

U.S. PATENT DOCUMENTS

| | | | | |
|---|---|---|---|---|
| 3,948,506 A | * | 4/1976 | Crimmins et al. | 271/126 |
| 3,976,291 A | * | 8/1976 | Bernardi et al. | 271/104 |
| 3,977,668 A | * | 8/1976 | Bologna et al. | 271/126 |
| 5,951,002 A | | 9/1999 | Yokota | |

FOREIGN PATENT DOCUMENTS

| | | | | |
|---|---|---|---|---|
| EP | 0 876 976 A2 | | 11/1998 | |
| JP | 3-88645 | * | 4/1991 | B65H/3/52 |
| JP | 3-267231 | * | 11/1991 | B65H/3/52 |
| JP | 4-164732 | * | 6/1992 | B65H/1/04 |
| JP | WO 93/18993 | | 9/1993 | |
| JP | 8-244992 | | 9/1996 | |
| JP | 9-255167 | | 9/1997 | |
| JP | 10-7266 | | 1/1998 | |

OTHER PUBLICATIONS

Supplemental European Search Report dated Feb. 25, 2002 (7 pages).

* cited by examiner

*Primary Examiner*—Donald P. Walsh
*Assistant Examiner*—Kenneth W Bower

(57) ABSTRACT

A paper feed apparatus having a pickup mechanism to pick up a plurality of paper sheets stacked on a chute one by one from the bottom and carrying the paper sheets to a predetermined standby position, comprises a gate 2 disposed facing a pickup roller 1 almost vertically with respect to the direction of paper feed to form a predetermined clearance, a paper-sheet separating pad 3 disposed in sliding contact with the pickup roller 1 to pick up the paper placed on the standby position one by one, and a pickup arm 4 that can be driven to be moved upward when setting paper sheets and downward when feeding paper sheets to push from above the paper sheets stacked on a chute 13 near a paper-sheet feed port. The pickup arm 4,when brought into free state as the planetary gear 5 disengages from the drive power transmission system, pushes paper sheets with a pushing force that increases with increases in the number of paper sheets stacked on the chute 13.

7 Claims, 28 Drawing Sheets

PAPER FEEDING DEVICE

TECHNICAL FIELD

The present invention relates generally to a paper feed apparatus. More particularly, the invention relates to a paper feed apparatus of a bottom discharge type having an automatic paper feed apparatus for use in image reading system where paper sheet separating performance for separating paper sheets being fed, such as manuscripts and cut sheets, can be enhanced, and operability can be improved by eliminating the need for special preliminary operations when setting paper sheets.

BACKGROUND ART

Most image reading devices for reading a large amount of manuscripts transported automatically have an automatic paper feed apparatus comprising a paper pickup mechanism for causing a plurality of paper sheets stacked on a chute to move to a predetermined standby position, a separating mechanism for separating and picking up and transporting the paper sheets onto the standby position one by one, a feed mechanism for transporting the paper sheet, and a paper discharge mechanism for discharging the paper sheets after image reading to a stacker or outside the paper feed apparatus. In recent years, the aforementioned automatic paper feed apparatus is controlled by a microprocessor in most cases.

FIG. 27 is a diagram illustrating a prior-art paper feeding apparatus. In the figure, a pickup roller 72 and a separating roller 73 are disposed so that both the rollers 72 and 73 can be rotated in the same direction via a gear 83, and also can be rotated in conjunction with a feed roller 74 via a gear 79, The pickup roller 72 is caused to make a sliding contact with a pressure arm 81, and the separating roller 73 is caused to make a sliding contact with a separating pad 80, respectively. A gate 84 is provided in a paper feed path between the pickup roller 72 and the separating roller 73.

The pressure arm 81, which is typically made of a spring member, is provided to ensure the transportation of a paper sheet set on the chute 71. An end of the pressure arm 81 is fixedly fitted to a (not shown), and the other end thereof is forced onto the paper sheet by a pushing force in the direction of the pickup roller 72. The pushing force, together with force between the pickup roller and the paper, acts to take up and transport the paper sheet to the separating roller 73.

The gate 84 is used to provide a clearance in the direction of paper thickness in the paper feed path so that a few sheets of paper can pass, and is disposed at an acutely inclined position with respect to the direction of paper entry into the paper feed path to ensure positive paper transport.

A one-way clutch is provided on each of the shafts of the pickup roller 72, the separating roller 73 and a discharge roller 75 so that the separating roller 73 can rotate only in a counterclockwise direction, and the discharge roller 75 only in a clockwise direction (paper feed direction). A sensor 82 for sensing the leading edge of paper is provided on the downstream side of the paper feed path near the separating roller 73. A sensor 85 for sensing the leading/trailing end of paper is also provided on the downstream side of the paper feed path near the feed roller 74.

In the aforementioned automatic paper feed apparatus, as a pulley 76 of a motor (not shown) is rotated in a counterclockwise direction, the feed roller 74 is rotated in a counterclockwise direction by a belt 77, that is, in the direction opposite to the direction of paper feed. The discharge roller 75 remains stationary even when the belt 77 is rotated. The pickup roller 72 and the separating roller 73 are rotated in a counterclockwise direction by gears 79 and 83. Consequently, paper sheets (not shown) stacked on the chute 71 are taken up one by one by the pickup roller 72, and transported toward the separating roller 73. Should multiple paper sheets be erroneously taken up en bloc, only one paper sheet that is in close contact with the pickup and separating rollers 72 and 73 is transported toward the feed roller 74 by the blocking action of the gate 84 and the separating pad 80. Thus, what is called double feeding can be prevented.

Next, even when the leading edge of the transported paper sheet reaches the feed roller 74, the paper sheet is not immediately fed to the feed roller 74, staying there for a while because the feed roller 74 is, rotated counterclockwise, or in the direction opposite to the paper feed direction. Thus, the edge of the paper sheet is aligned during the period. The retention time of the paper sheet is controlled based on a predetermined number of pulses or a predetermined time after the sensor 82 has detected the leading edge of the paper sheet. After the lapse of a predetermined retention time, the motor (not shown) is reversed to cause the pulley 76 to rotate clockwise. As a result, the feed and discharge rollers 74 and 75 are also caused to rotate clockwise by the belt 77, with the paper sheet transported to the reading mechanism 78 by the feed roller 74. Immediately before it, the leading edge of the paper sheet is detected by the sensor 85, and reading is initiated by a signal generated by the sensor 85. As the sensor 85 detects the trailing end of paper, reading is terminated and the paper sheet is discharged onto a stacker (not shown) by the discharge roller 75.

In the aforementioned automatic paper feed apparatus where multiple sheets of paper 90 as shown in FIG. 28(*a*) are set on the chute 71, a preparatory operation is required to form the leading edges of the paper sheets into a knife edge 91, or cause the leading edges of the paper sheets to feather, as shown in FIG. 28 (*b*), to ensure that paper sheets are taken up onto the separating roller 73 smoothly and positively.

As described above, the paper feed apparatus of the prior art has the following problems:

(1) Since the gate for providing a clearance in the paper thickness direction in the paper feed path is disposed at an acutely inclined position to the paper entry direction, the resulting vertical component force produces a force contributing to unwanted multiple-sheet feeding, lowering the paper separating performance.

(2) When setting multiple sheets of paper on the chute, a preparatory operation is needed to form the leading edges of paper sheets into a knife edge (or cause the front face of the paper stack to feather). This preparatory operation, however, is so complex that the operator is often induced to neglect it. This may result in failure to ensure smooth paper feeding.

(3) As described above, the separating roller is disposed between the pickup and feed rollers, and the pickup roller is caused to make sliding contact with the pressure arm, and the separating roller with the separating pad. All these arrangements have made the transport mechanism of the prior-art paper feed apparatus an oversized unit.

It has been required that the aforementioned problems in the prior-art paper feed apparatus be solved, and that all paper sheets, large or small, be properly supplied in the paper feed apparatus. That is, pickup errors that could happen when handling a large amount of paper sheets, or multiple-sheet feeding associated with a small number of paper sheets, or paper jams associated with thin paper sheets must be prevented.

It is an object of this invention to provide a paper feed apparatus that can feed paper sheets properly.

DISCLOSURE OF THE INVENTION

To overcome the above-mentioned problems, a paper feed apparatus embodying the present invention employs the following means:

In a paper feed apparatus having a pickup mechanism to pick up a plurality of sheets of paper stacked on a chute one by one from the bottom, and carrying the paper sheet to a predetermined preparatory position;

a gate disposed facing the pickup roller almost vertically with respect to the direction of paper entry to form a predetermined clearance, a paper-sheet separating pad making sliding contact with the pickup roller to pick up the paper sheets placed on the preparatory position one by one, and a pickup arm that is moved upward when setting paper sheets, and moved downward when feeding the paper sheets, to push from above the paper sheets stacked on the chute at the paper feeding port are provided;

the pickup arm is driven by a planetary gear-based clutch mechanism and a motor for feeding paper sheets that is used in common as a drive source for the pickup arm in such a manner that the pickup arm is moved downward as the forward rotation of the motor disengages the planetary gear from a drive power transmission system, and the pickup arm is moved upward as the reverse rotation of the motor engages the planetary gear with the drive power transmission system; and the pickup arm, when brought into free state as the planetary gear are disengaged from the drive power transmission system, pushing the paper sheets with a pushing force that increases with increases in the number of paper sheets stacked on the chute.

By employing the above means, the paper feed apparatus embodying the present invention can make the whole unit compact in size and prevent multiple-sheet feeding force from being generated in a gate mechanism disposed almost vertically with respect to the paper entry direction, thereby improving the paper separating performance. Furthermore, paper-sheet edge aligning operation can be eliminated when a plurality of paper sheets are set on the chute by maintaining positive paper-sheet pickup performance. Furthermore, paper sheets can be pushed with an optimum pushing force by the pickup arm since a small pushing force is exerted on the paper sheets when a small number of paper sheets are stacked on the chute, while a large pushing force is applied when a large number of paper sheets are stacked on the chute. As a result, the rate of successful paper pickup against user's paper-sheet setting can be improved even when thin paper sheets are used, and power consumption in the motor can be reduced.

BEST MODE FOR CARRYING OUT THE INVENTION

One way of carrying out the invention is described in detail in the following.

Figure 1:
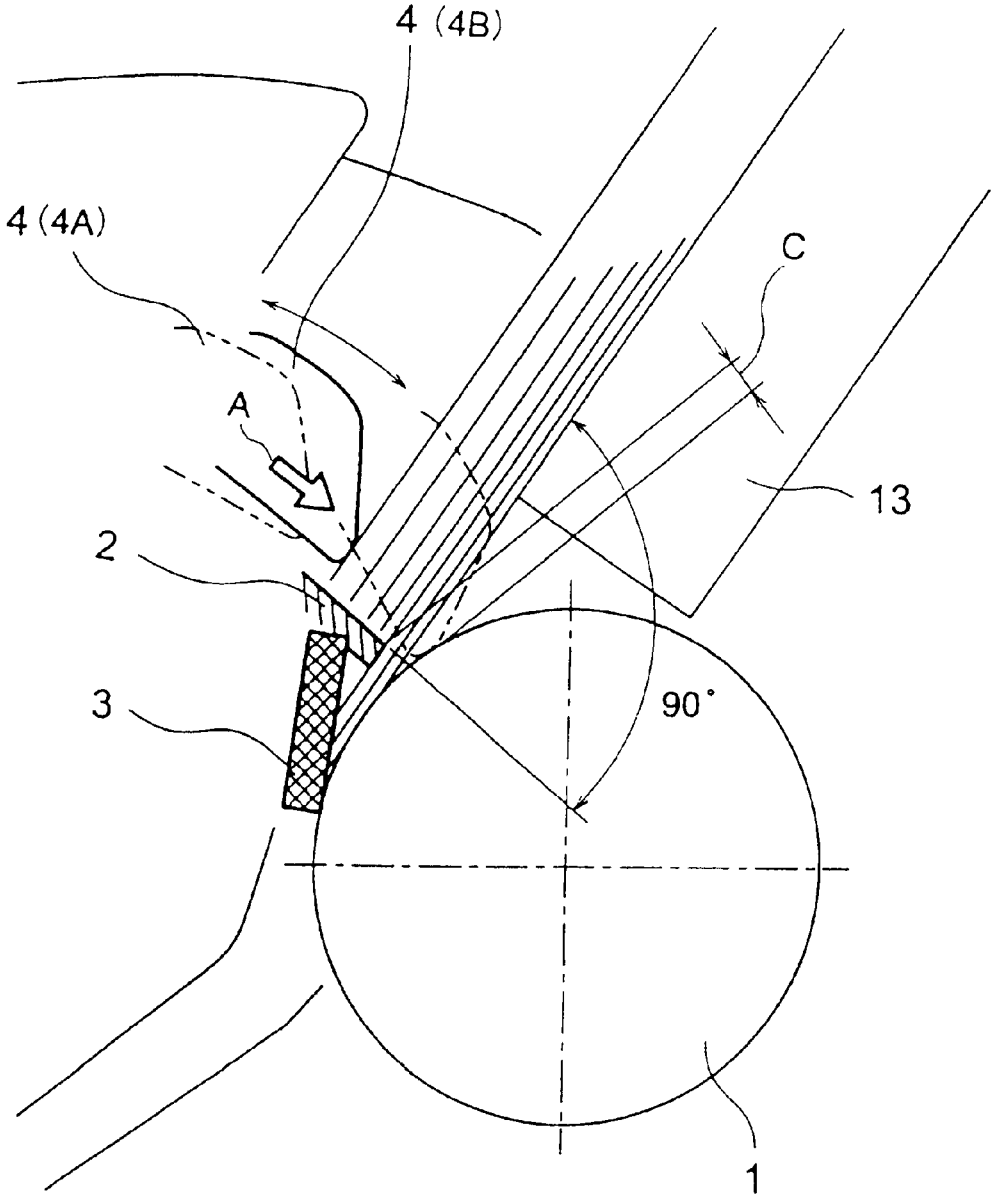
FIG. 1 is a diagram showing an embodiment of the present invention.

As shown in FIG. 1, the paper feed apparatus according to the present invention has a pickup mechanism to pick up a plurality of paper sheets stacked on a chute 13 one by one from the bottom and transporting the paper sheets to a predetermined preparatory position, and comprises:

a gate 2 disposed almost vertical with respect to the direction of paper entry and providing a predetermined clearance on a pickup roller 1;

a paper-sheet separating pad 3 to pick up the paper sheets placed on the preparatory position one by one by making sliding contact with the pickup roller 1; and a pickup arm 4 that is driven in such a manner that the pickup arm 4 can be moved upward when in standby state (when setting paper sheets), and moved downward when feeding paper sheets, so that the paper sheets stacked on the chute 13 can be pushed from above at the paper feeding port by the pressure exerted by the pickup arm 4 via pressing means (not shown).

In the aforementioned embodiment, the paper feed apparatus can be made compact in size because a plurality of sheets of paper stacked on the chute can be picked up one by one from the bottom and transported to the paper feed path by disposing a pickup roller, and a gate, paper-sheet separating pad and a pickup arm on the pickup roller. Moreover, paper-sheet separating performance can be improved in the aforementioned embodiment since the gate is provided almost vertically with respect to the direction of paper entry, thereby eliminating possible vertical component forces and multiple-sheet feeding force at the gate. Further, improved pickup performance can help improve operability because the edge aligning operation, such as forming the leading edge of paper into a knife edge, can be eliminated when multiple sheets of paper are set on the chute.

The paper feed apparatus of the present invention having the aforementioned construction may have a pre-pickup roller 42 adapted to be driven in such a manner that the pre-pickup roller 42 is moved downward when setting paper sheets, and upward when feeding paper sheets, so that the paper sheets stacked on the chute can be transported to the gate 2 by picking up the paper sheets in advance from the rear surface while causing the pre-pickup roller 42 to rotate at a peripheral speed lower than the peripheral speed of the pickup roller 1.

By providing the pre-pickup roller 42, the paper-sheet pickup performance can be further improved.

In the paper feed apparatus of the present invention having this construction, the rotating fulcrum of the pickup arm 4 is provided at such a location that the tip of the pickup arm 4 pushes the paper at a location away from the gate 2 as the number of paper sheets stacked on the chute increases.

The movement of the pickup arm 4 is such that when a small number of paper sheets are stacked on the chute, the pickup arm 4 pushes the paper at a location nearer to the gate 2, thereby preventing paper sheets from curling, and that when a large number of paper sheets are stacked on the chute, the pickup arm 4 pushes the paper at a location remote from the gate 2, thereby improving the rate of successful paper pickup against the user's paper setting.

Figure 4:
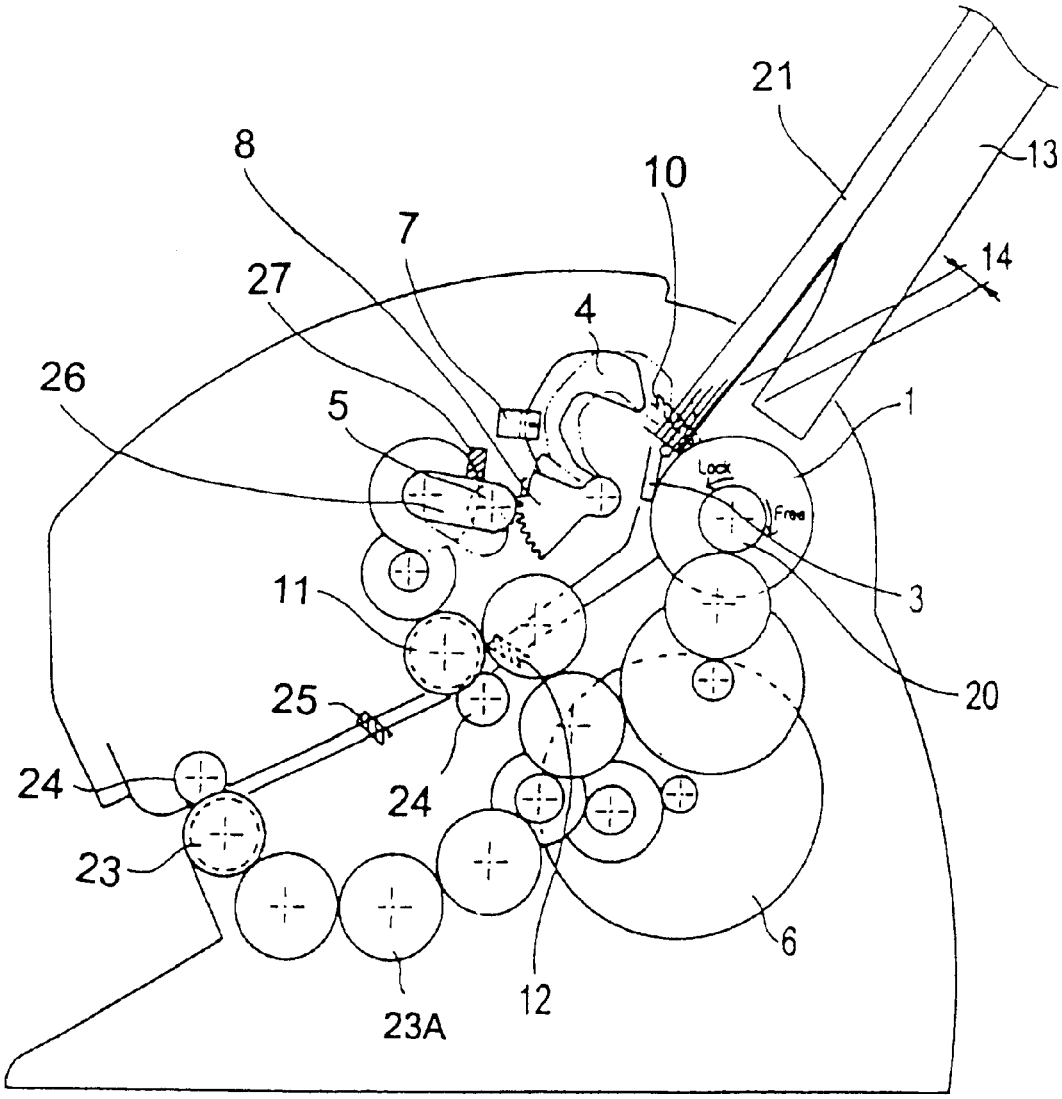
Figure 5:
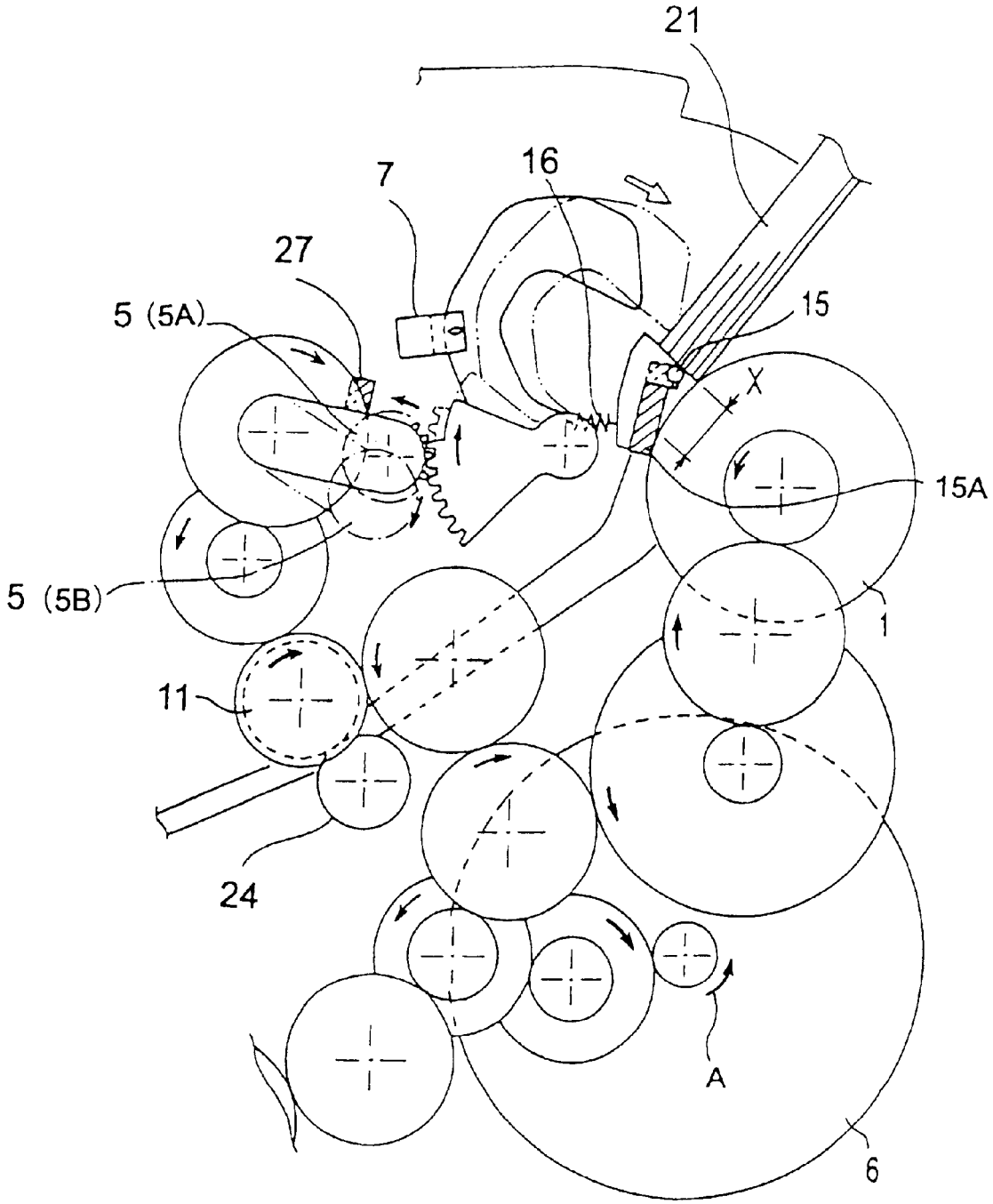

As shown in FIGS. 4 and 5, the paper feed apparatus according to the present invention has a clutch mechanism based on a planetary gear 5 to drive the pickup arm 4, using in common the motor 6 for transporting paper sheets as a drive source for the pickup arm 4. In the clutch mechanism, the forward rotation of the motor 6 disengages the planetary gear 5 from a drive power transmission system, causing the pickup arm 4 to move downward, while the reverse rotation of the motor 6 engages the planetary gear 5 with the drive power transmission system, causing the pickup arm 4 to move upward.

With the aforementioned arrangement, a single drive source can perform both paper transport and pickup arm lifting/lowering operations, thereby reducing the number of components and making the paper feed apparatus compact in size.

With this arrangement, when the pickup arm 4 of the paper feed apparatus according to the present invention is in an idle state as the result of disengagement of the planetary gear 5 from the drive power transmission system, the pickup arm 4 pushes the paper with a pushing force that increases with increases in the number of paper sheets stacked on the chute.

The pickup arm 4 pushes the paper with a small pushing force when the number of paper sheets stacked on the chute is small, and pushes the paper with a large pushing force when the number of paper sheets stacked on the chute is large. Thus, the paper is kept pushed at all times with an optimum pushing force.

As shown in FIGS. 4 and 5, the planetary gear-based clutch mechanism in the paper feed apparatus according to the present invention has a pickup arm sensor 7 for sensing that the pickup arm 4 has moved upward as the reverse rotation of the motor 6 causes the planetary gear 5 to engage with the drive power transmission system. Thus, the planetary gear-based clutch mechanism has a function of keeping moving the pickup arm 4 upward until the pickup arm sensor 7 detects the pickup arm 4.

With this arrangement, the frame of the planetary gear that operates by frictional forces tends to cause erratic delays in operation. To cope with this, the pickup arm sensor accurately senses the operation of the pickup arm.

Figure 7:
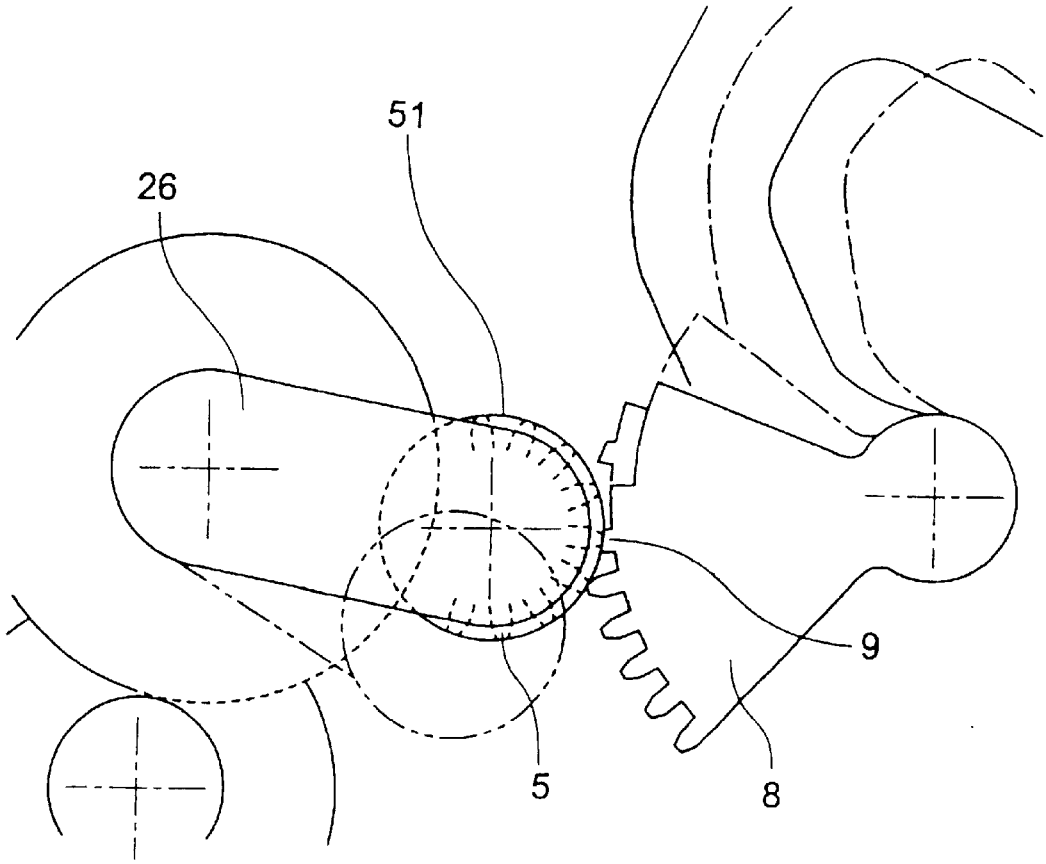

As shown in FIG. 7, the planetary gear-based clutch mechanism in the paper feed apparatus according to the present invention has a cut-tooth portion 9 formed by removing part of teeth of the pickup arm driving gear 8 by the depth of the addendum circle of the planetary gear 5, which is in mesh with the planetary gear 5 to drive the pickup arm 4.

Figure 6:
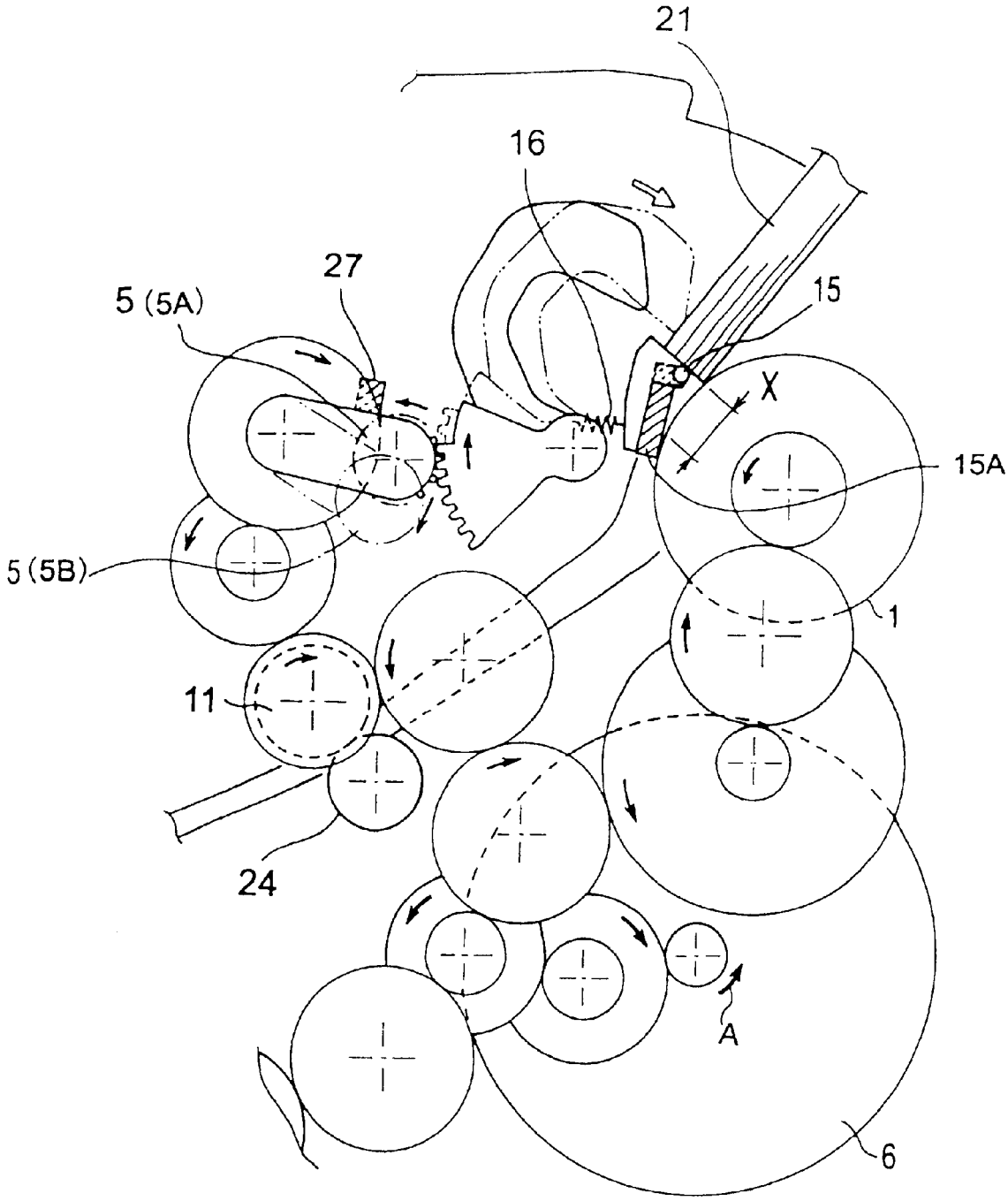

In this case, as shown in FIG. 6, the pickup arm sensor 7 shown in FIG. 5 is not provided.

With the aforementioned arrangement, the number of teeth of the pickup arm driving gear is reduced to the required minimum and the number of motor reversing pulses is increased so as to make the pickup arm assembly compact in size, and to reduce the stroke of tooth skipping, which is carried out when there are few delays in operation to prevent the pickup arm from lifting excessively. This can also reduce tooth skipping noise (tooth rasping noise) that gives discomfort to the user.

As shown in FIG. 4, the paper feed apparatus according to the present invention has a chute-mounted paper-sheet sensor 10 that is installed in such a positional relationship that the sensor 10 stays in OFF state even when a manuscript 21 is set on the chute 13 in the state where the pickup arm 4 stays in the lower position, and change to ON state when the manuscript 21 is set on the chute in the state the pickup arm 4 is in the upper position, and has a function of not executing the operation of lifting the pickup arm 4 after the paper feed apparatus has been initialized or reset as long as the chute-mounted paper-sheet sensor 10 senses the presence of paper sheets.

With the aforementioned arrangement, even if an attempt is made to initialize or reset the paper feed apparatus in the state where paper sheets are kept set on the chute, paper sheets on the chute are prevented from being picked up into the paper feed path.

As shown in FIG. 4, the paper feed apparatus according to the present invention has a paper-sheet sensor between pickup/feed rollers 12 for detecting the presence/absence of paper sheets between the pickup and feed rollers in the paper feed path. When no paper sheets are picked up, paper sheets stacked on the chute 13 are jogged by the pickup arm 45 by causing the motor 6 to repeat the forward/reverse rotation of the motor 6.

Thus, pickup performance can be improved with this arrangement by jogging paper sheets when no paper sheets are picked up.

As shown in FIG. 4, a shouldered part 14 is provided in the paper feed apparatus according to the present invention by slightly lowering the level of the chute 13 near the paper feed port.

With this arrangement, the shouldered part 14 makes the paper stack cantilevered, thereby reducing the resistance of the paper stack to the pushing force exerted by the pickup arm. This permits the pressure exerted by the pickup arm onto the paper stack to be transmitted accurately to the pickup roller even with upwardly curled paper sheets, leading to improved paper pickup performance.

As shown in FIGS. 5 and 6, the gate 2 is integrally formed with a member for holding the paper-sheet separating pad 3 in the paper feed apparatus according to the present invention. A rotating fulcrum 15 is provided at an end of the member almost in alignment with the tip of the gate 2, with the other end of the member pushed by a paper-sheet separating pressure imparting spring 16.

With this arrangement, the distance X from the gate to the paper-sheet separating pad can be reduced to the minimum, and therefore the possible curling of the edges of paper sheets between the gate and the paper-sheet separating pad can be reduced to the minimum. Thus, paper feeding performance can be improved, and the gate and the paper-sheet separating pad, and accordingly the paper feed apparatus, can be made compact in size. In addition, since the location of the rotating fulcrum is aligned with the tip of the gate, a constant gate gap (clearance) can be maintained, regardless of variations in the thickness of the paper-sheet separating pad and friction between the paper sheet and the paper-sheet separating pad, thereby contributing to stabilized paper feeding performance.

Figure 8:
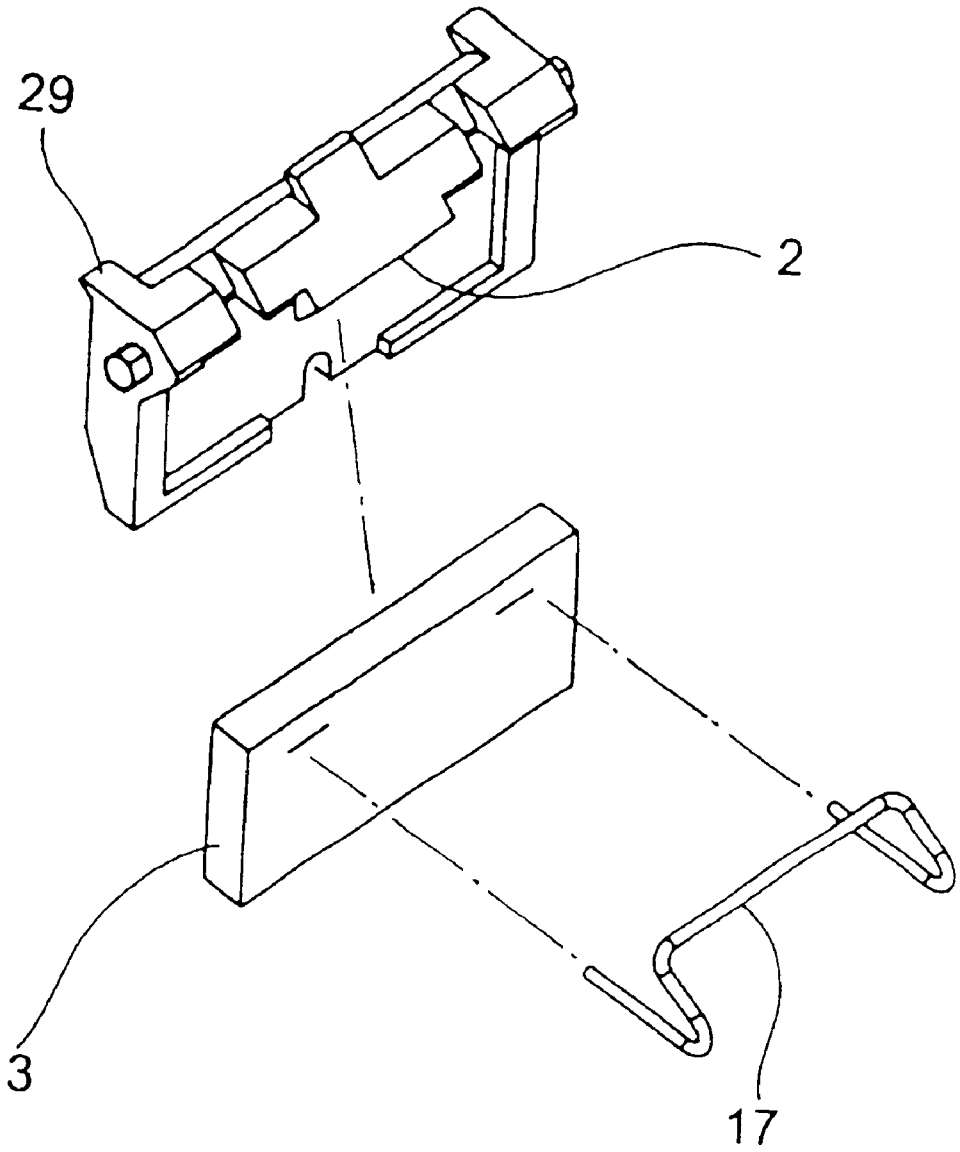
Figure 9:
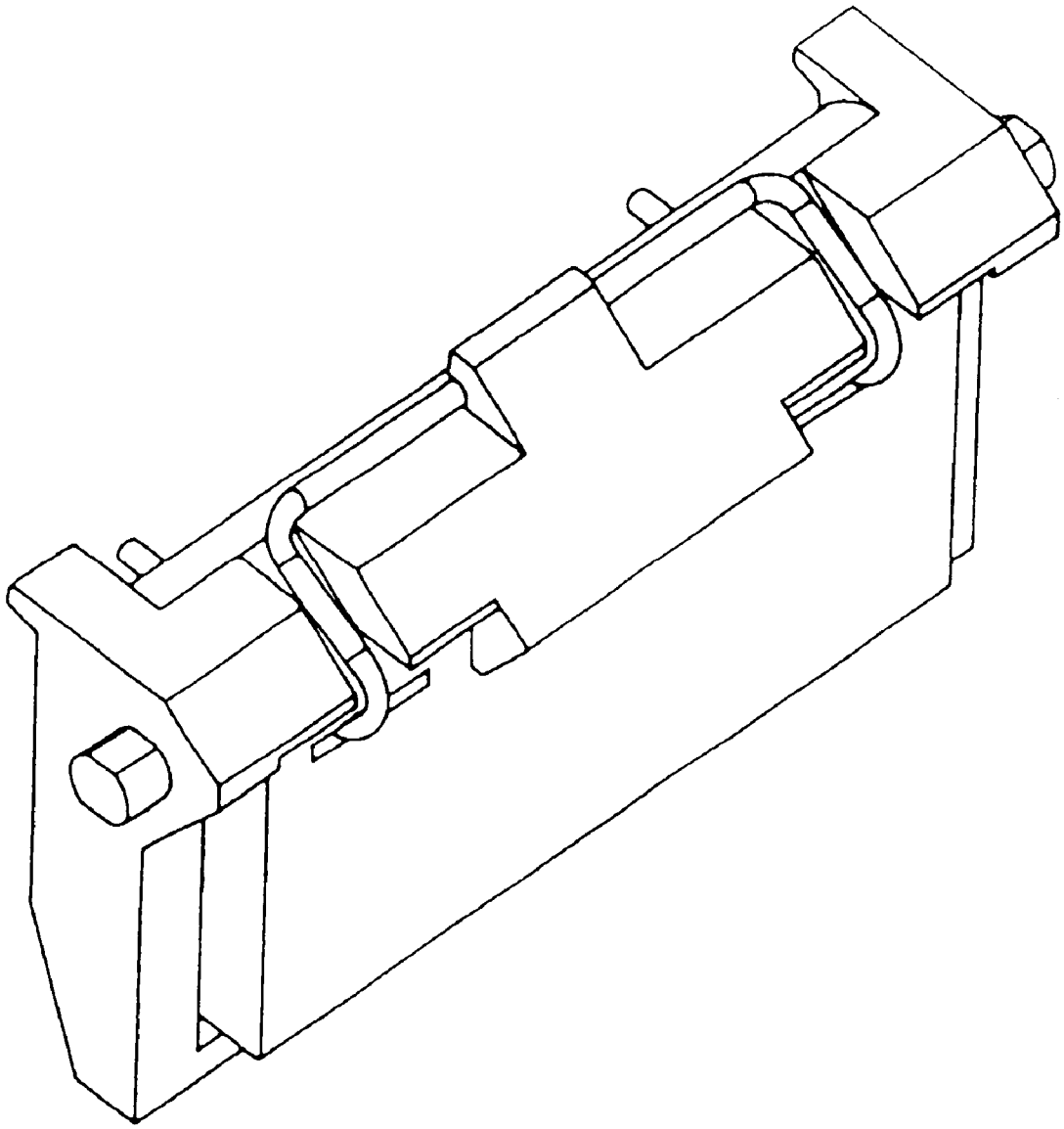
Figure 10:
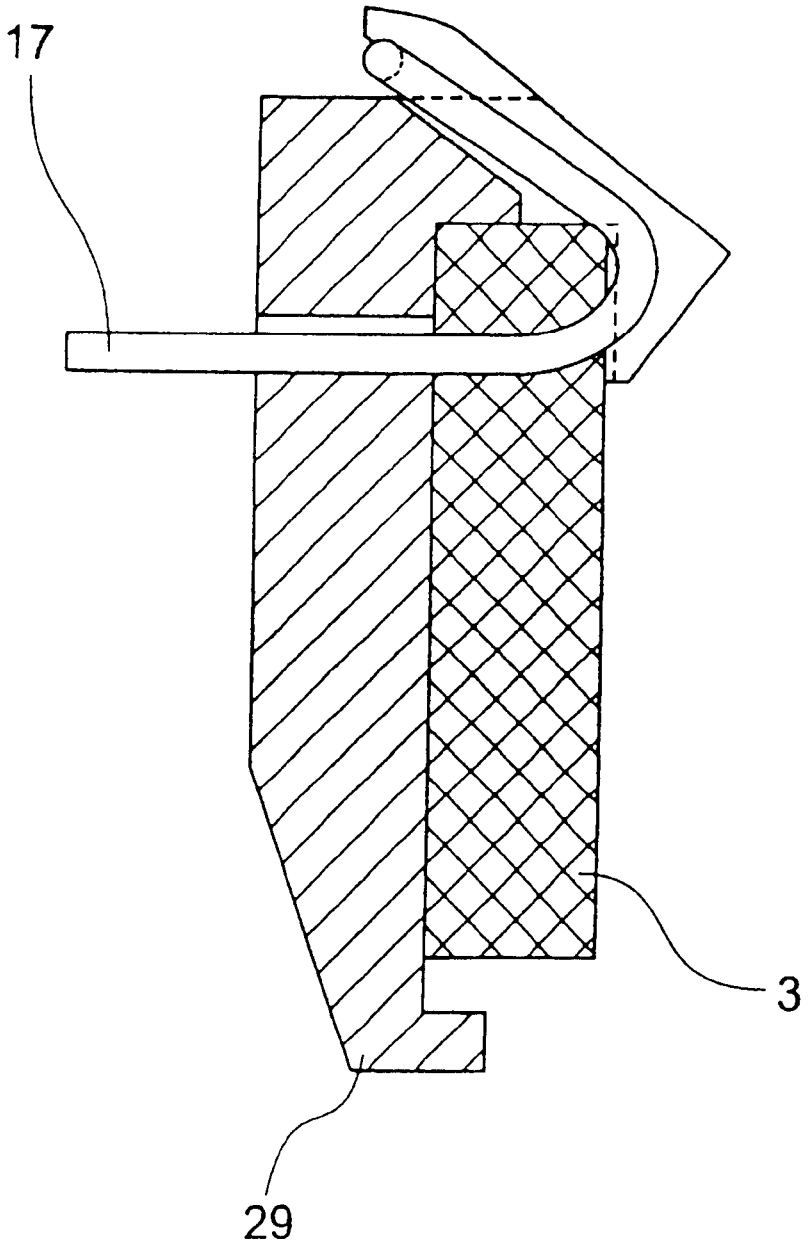

As shown in FIGS. 8 to 10, the gate 2 of the paper feed apparatus according to the present invention is formed by molding a resin, and the paper-sheet separating pad 3 is installed by inserting a pad retaining spring 17 made of a wire member near the gate.

With this arrangement, mechanical fixation can be accomplished within a limited range, thus making the gate and the paper-sheet separating pad, and accordingly the paper feed apparatus, compact. Since there is no fear of peeling the paper-sheet separating pad 3, stabilized paper-sheet separating performance can be achieved. Compared with the use of adhesive to install the paper-sheet separating pad, installation takes less time with this arrangement because no drying time is needed.

Figure 11:
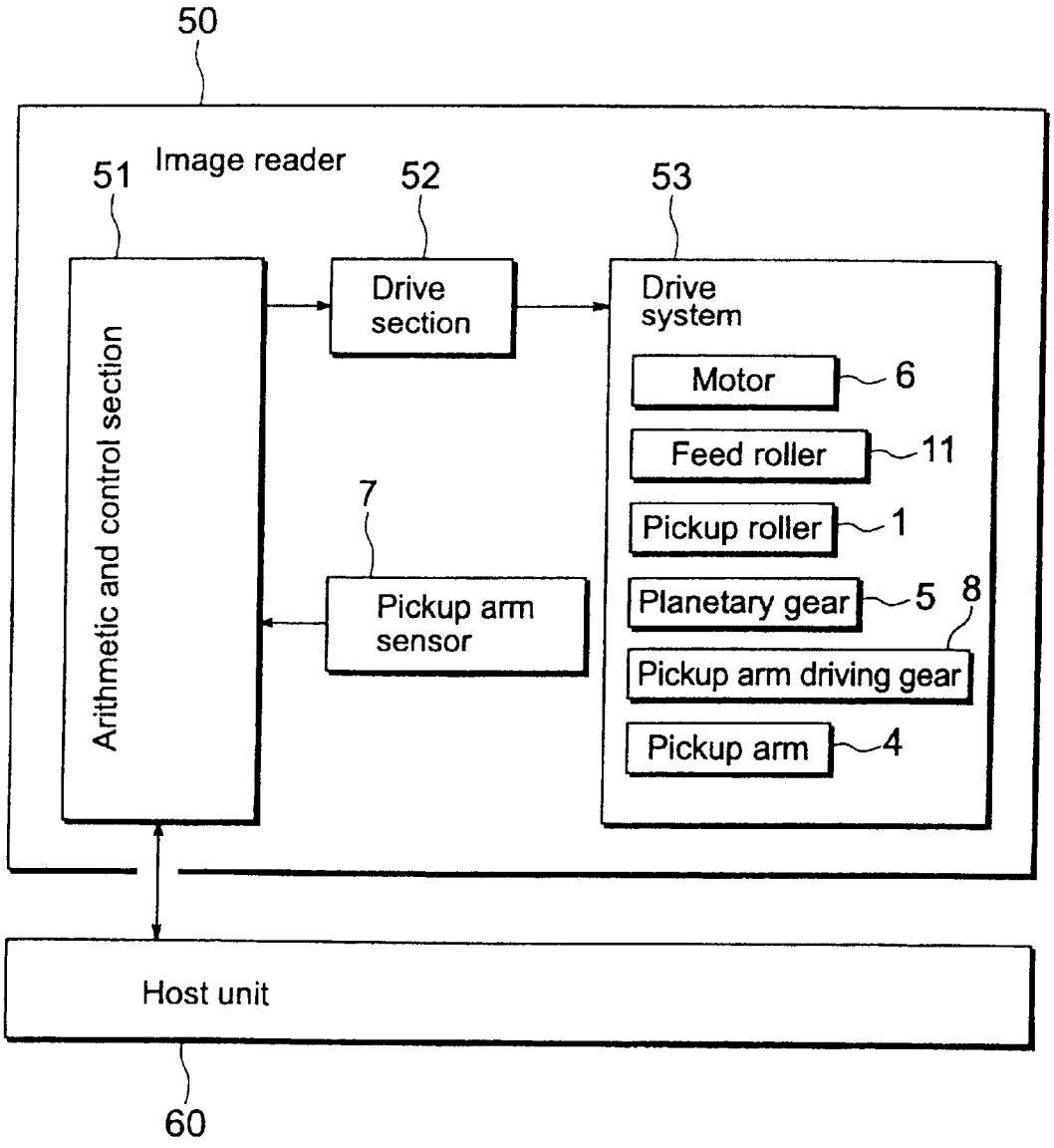
FIGS. 11 through 14 are block diagrams showing embodiments of the present invention.
Figure 15:
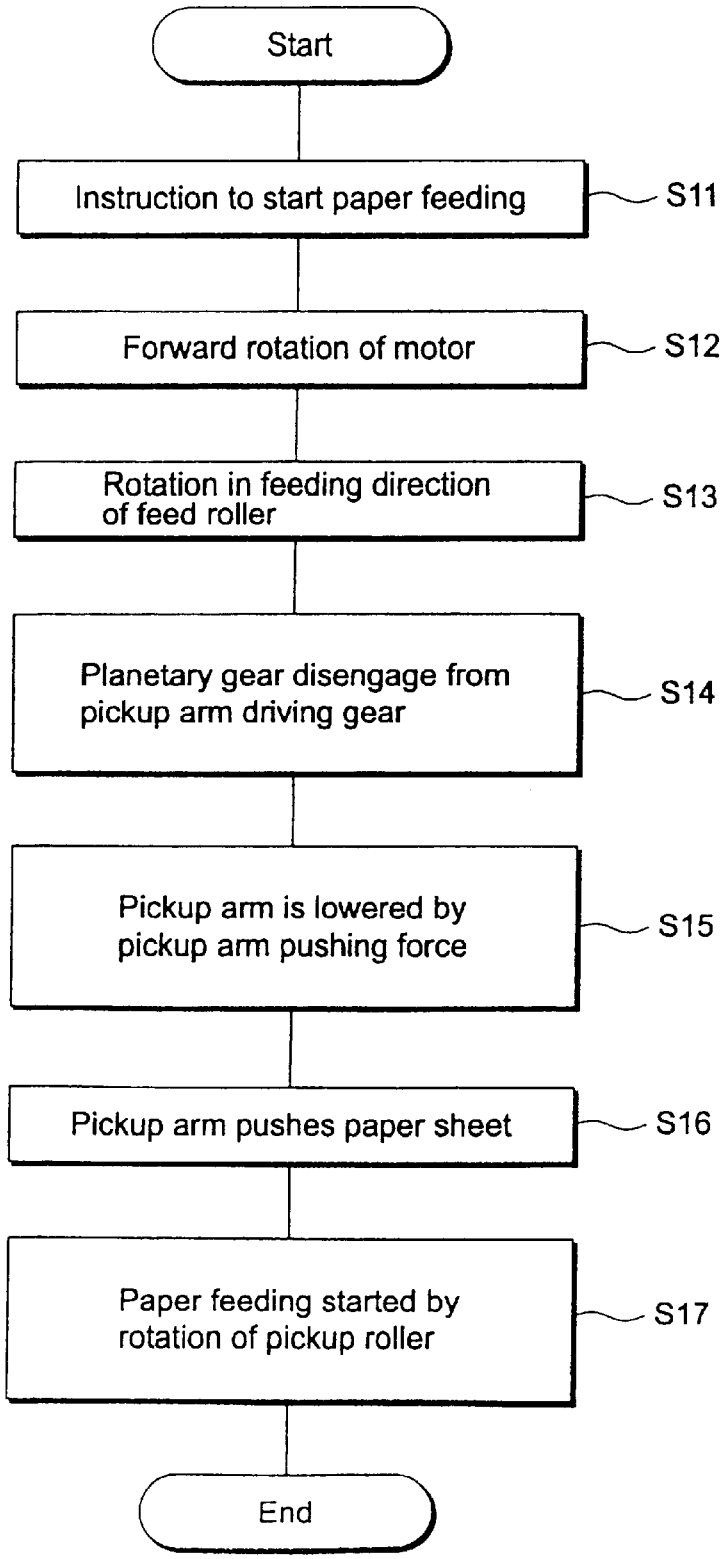
FIGS. 15 through 19 are flow charts of embodiments of the present invention.
Figure 16:
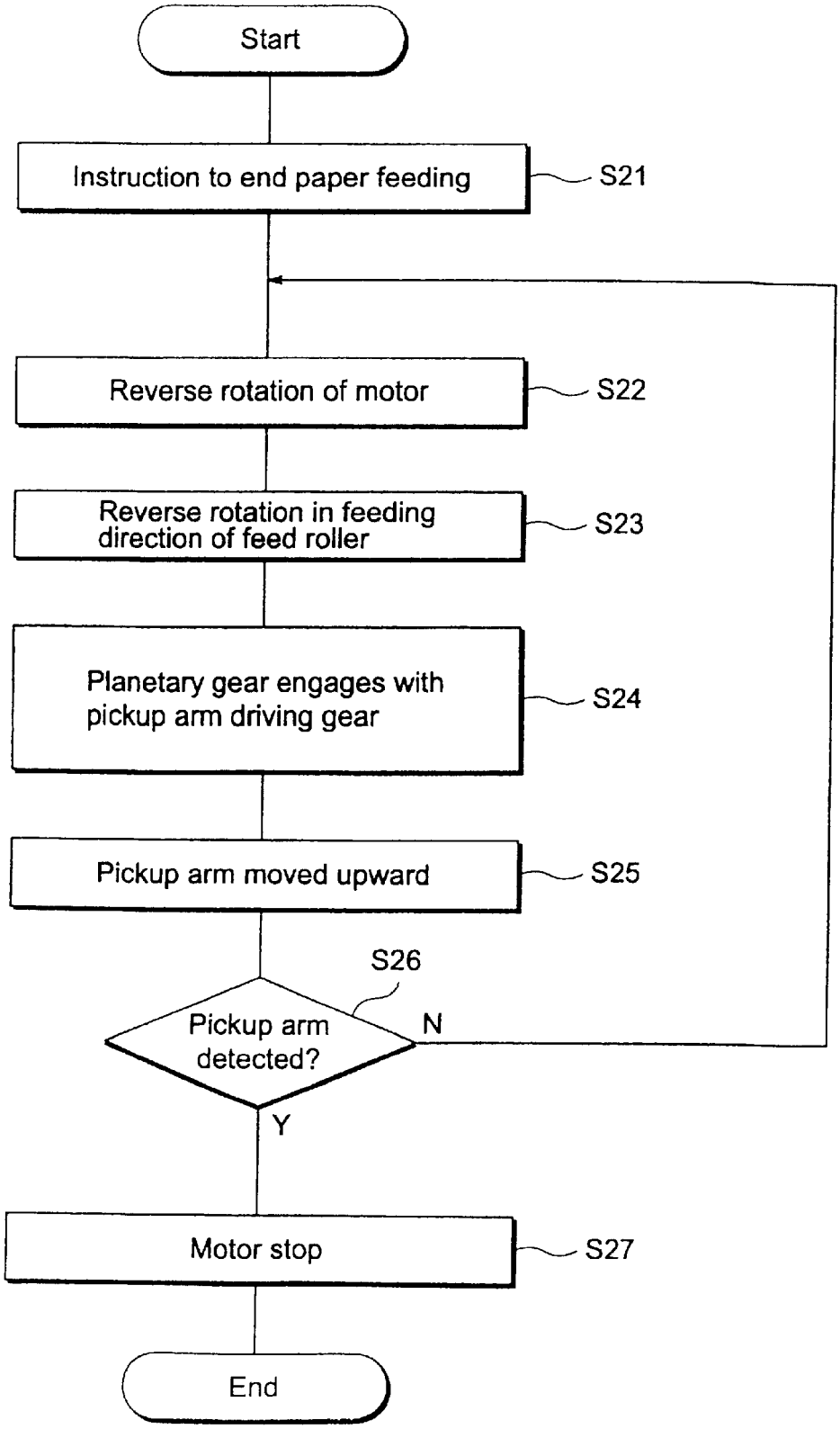

As shown in FIGS. 11, 15 and 16, in a case of controlling the paper feed apparatus according to the present invention (refer to FIG. 5) comprising a pickup mechanism to pick up a plurality of paper sheets stacked on the chute one by one from the bottom and moving them to a predetermined preparatory position, a pickup arm, which is moved upward when setting paper sheets and downward when feeding the paper sheets, to push from above the paper sheets stacked on the chute, and a pickup arm sensor for detecting the pickup arm is moved upward, the controlling method for the paper feed apparatus of the present invention comprises:

causing the paper feeding motor 6 to forward rotate, based on a paper feed start instruction, to disengage the planetary gear 5 from the pickup arm driving power transmission system to move the pickup arm 4 downward, exerting initial pressure onto the paper stack to start paper feeding, and causing the paper feeding motor 6 to reverse rotating, based on a paper feed end instruction, to engage the planetary gear 5 with the pickup arm driving power transmission system to move the pickup arm 4 upward until the pickup arm sensor 7 detects the pickup arm 4.

With this arrangement, paper feeding and pickup arm operation can be carried out by a single drive source, reducing the required number of component parts and making the paper feed apparatus compact in size. The frame of the planetary gear, which operates by frictional forces, tends to cause erratic delays in operation. The pickup arm sensor, however, can accurately detect the operation of the pickup arm.

Figure 12:
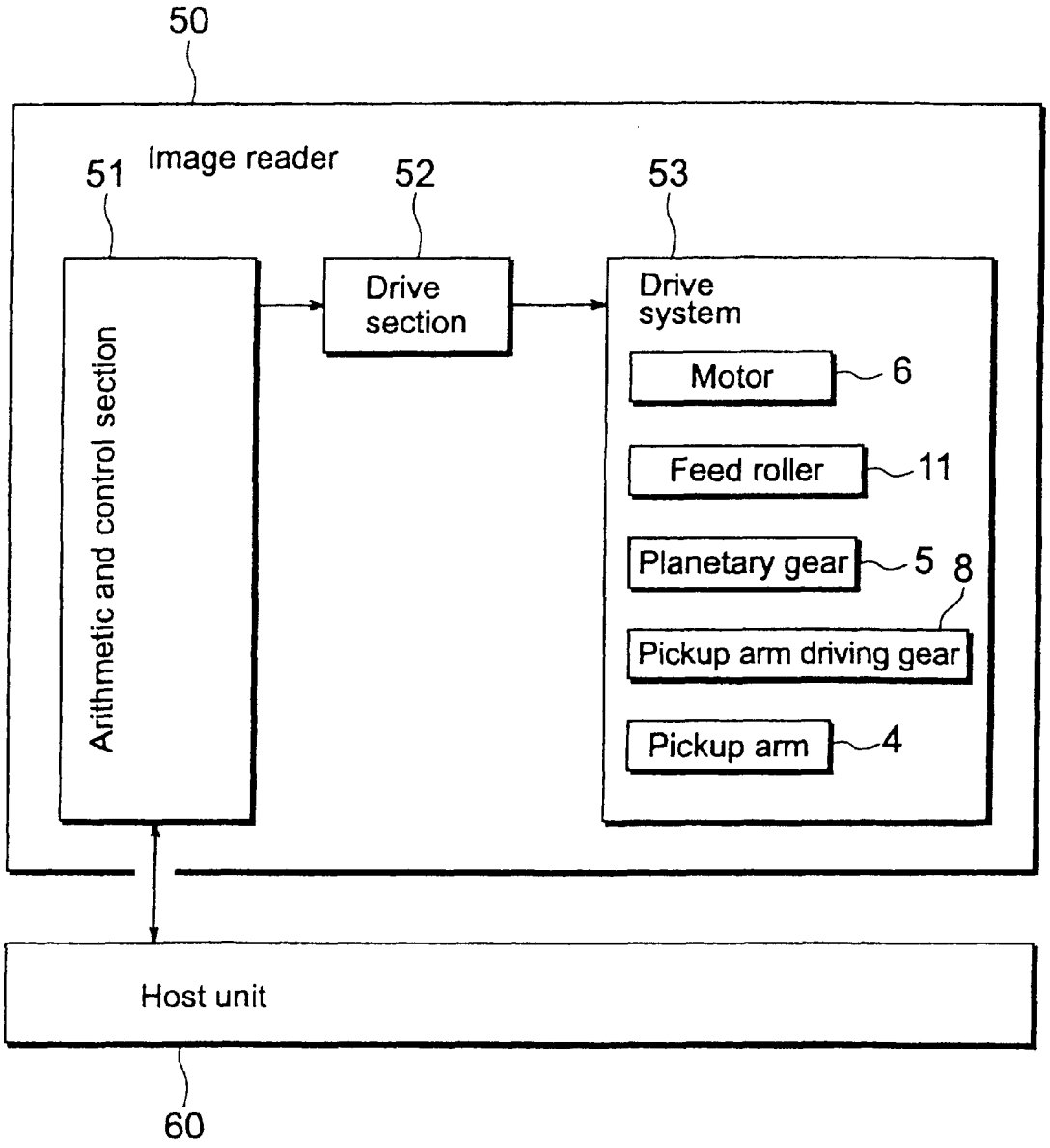
Figure 17:
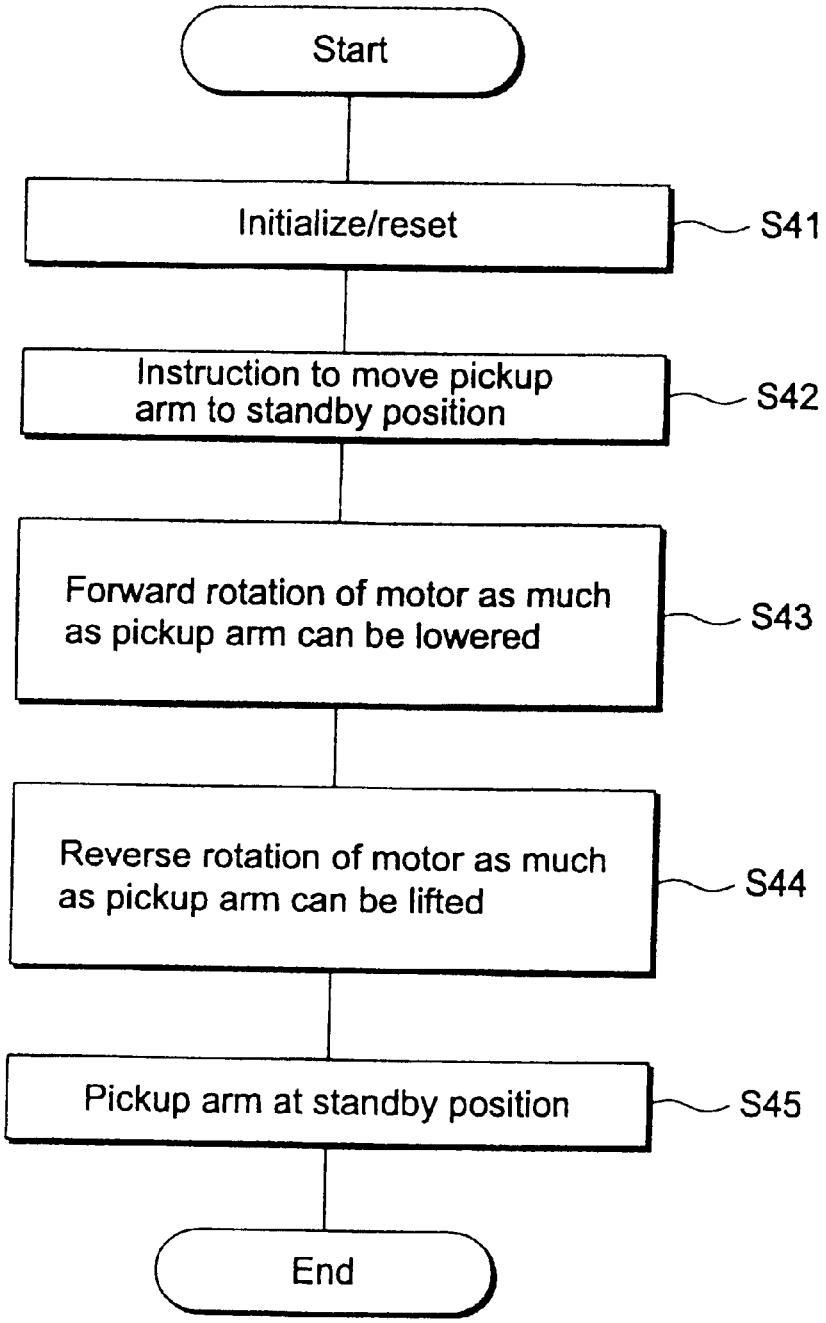

As shown in FIGS. 12 and 17, in a case of controlling the paper feed apparatus according to the present invention (refer to FIG. 6) comprising a pickup mechanism to pick up a plurality of paper sheets stacked on the chute one by one from the bottom and moving them to a predetermined standby position, a pickup arm, which is moved upward when setting paper sheets and downward when feeding the paper sheets, to push from above the paper sheets stacked on the chute, and a pickup arm sensor for detecting the pickup arm is moved upward, the controlling method for the paper feed apparatus of the present invention comprises:

causing the paper feeding motor 6 to forward rotate to move the pickup arm downward as much as the pickup arm can be lowered when moving the pickup arm 4 upward after the paper feed apparatus has been initialized or reset, and causing the motor 6 to reverse rotate as much as the pickup arm can be lifted to a predetermined amount after the operation of lowering the pick up arm 4 has been carried out.

With the aforementioned arrangement, in which the means for detecting the operation of the pickup arm is not provided, a function of preventing the pickup arm from lifting overly must be provided to make the pickup arm portion compact. With this arrangement, tooth skipping noise (tooth rasping noise) can be eliminated even when the pickup arm sensor is omitted.

Figure 13:
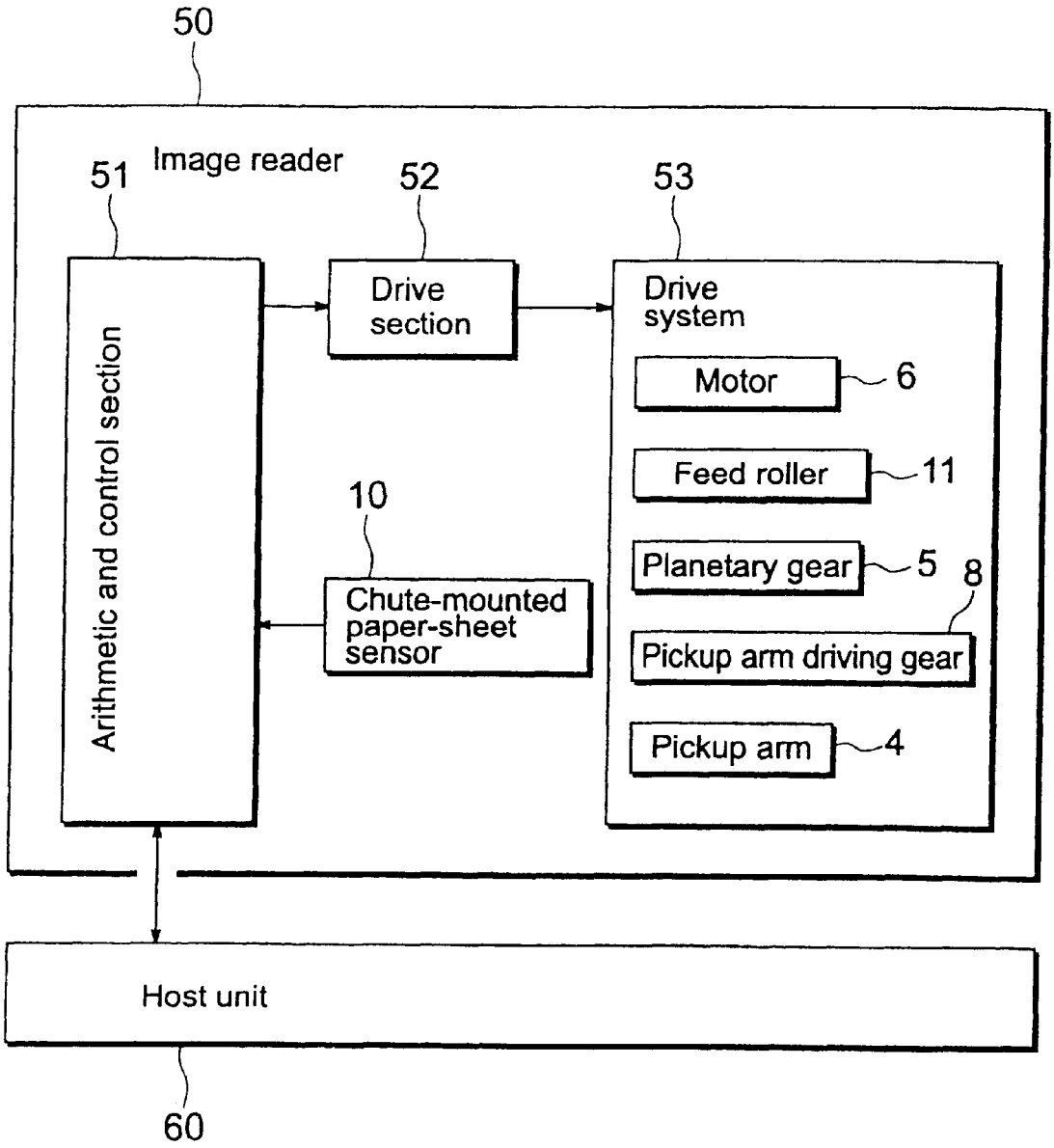
Figure 18:
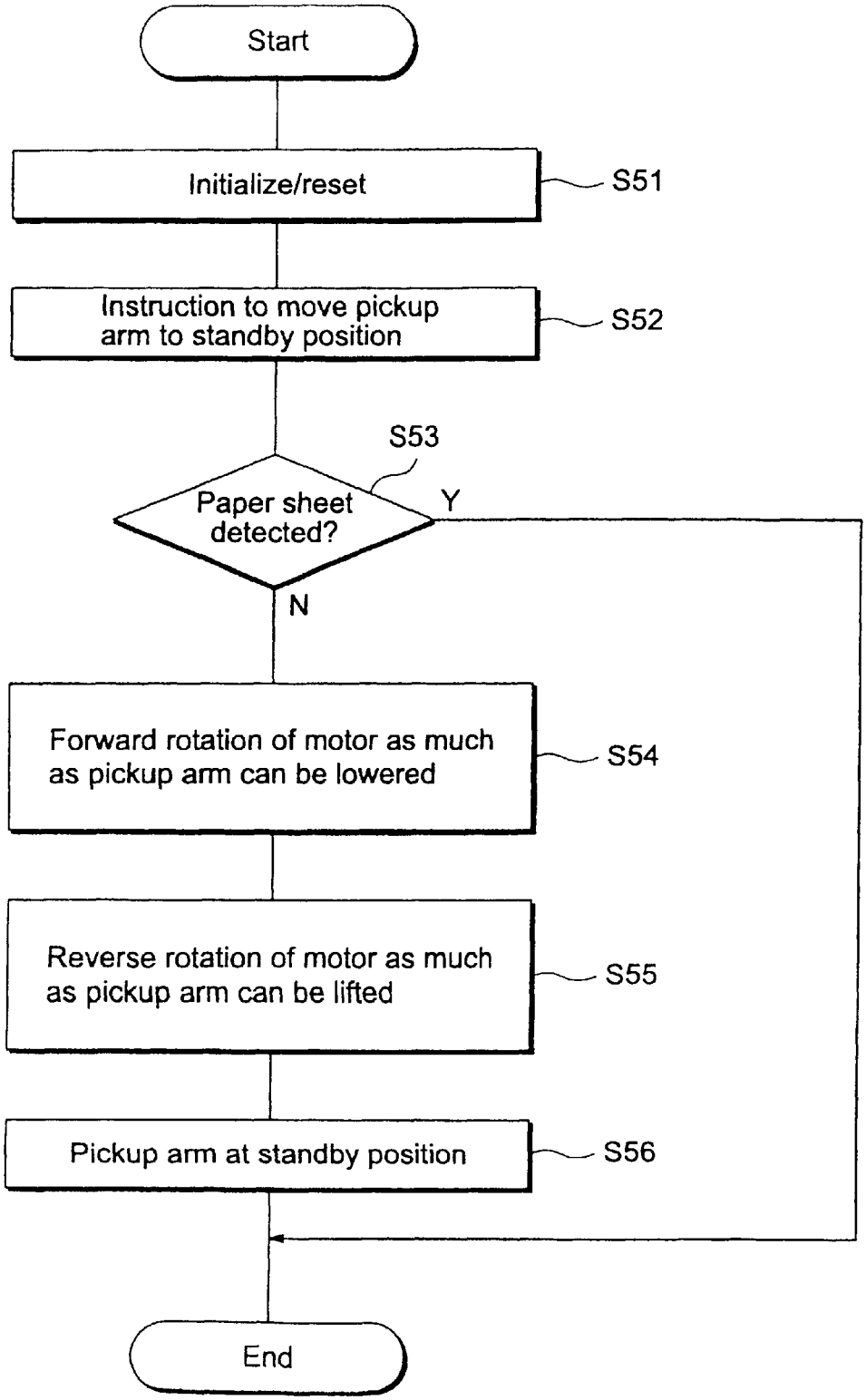

As shown in FIGS. 13 and 18, the controlling method for the paper feed apparatus of the present invention comprises, in the operation of lifting the pickup arm 4 after the paper feed apparatus has been initialized or reset, the operation of lifting the pickup arm 4 is omitted in a case that the chute-mounted paper-sheet sensor 10 actually detects the paper sheet, the sensor 10 being installed in such a positional relationship that when a paper sheet is set on the chute 13 in the state where the pickup arm 4 is in the lower position, the sensor 10 does not detect the paper sheet, and when the paper sheet is set on the chute in the state the pickup arm 4 is in the upper position, the sensor 10 detects the paper sheet.

With this arrangement, the paper sheet on the chute is prevented from being taken in the paper feed path even when an attempt is made to initialize or reset the paper feed apparatus in the state that the paper sheet is set on the chute because the operation of lifting the pickup arm is not carried out when a paper sheet is detected set on the chute in the state where the pickup arm is in the upper position.

Figure 14:
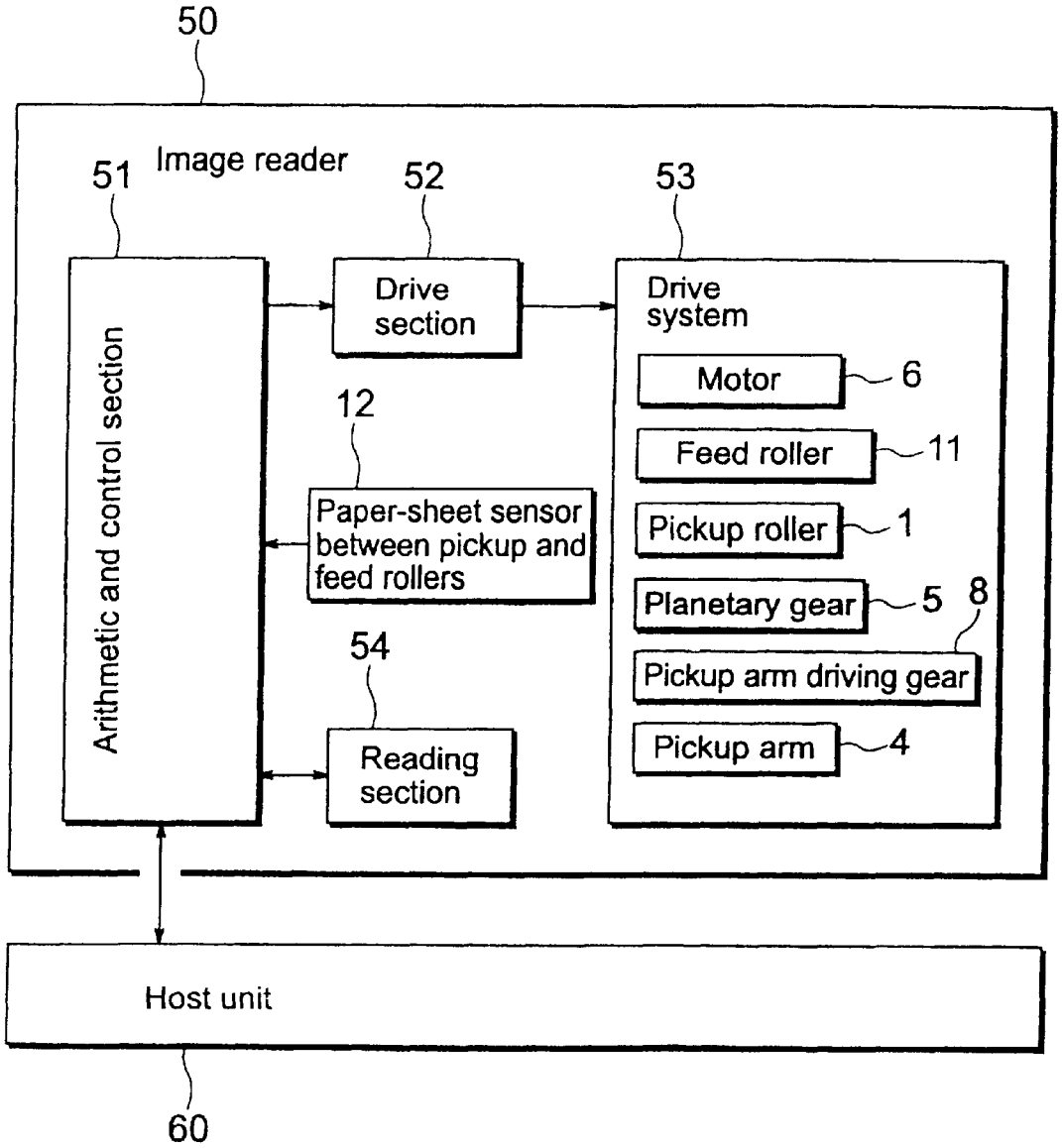
Figure 19:
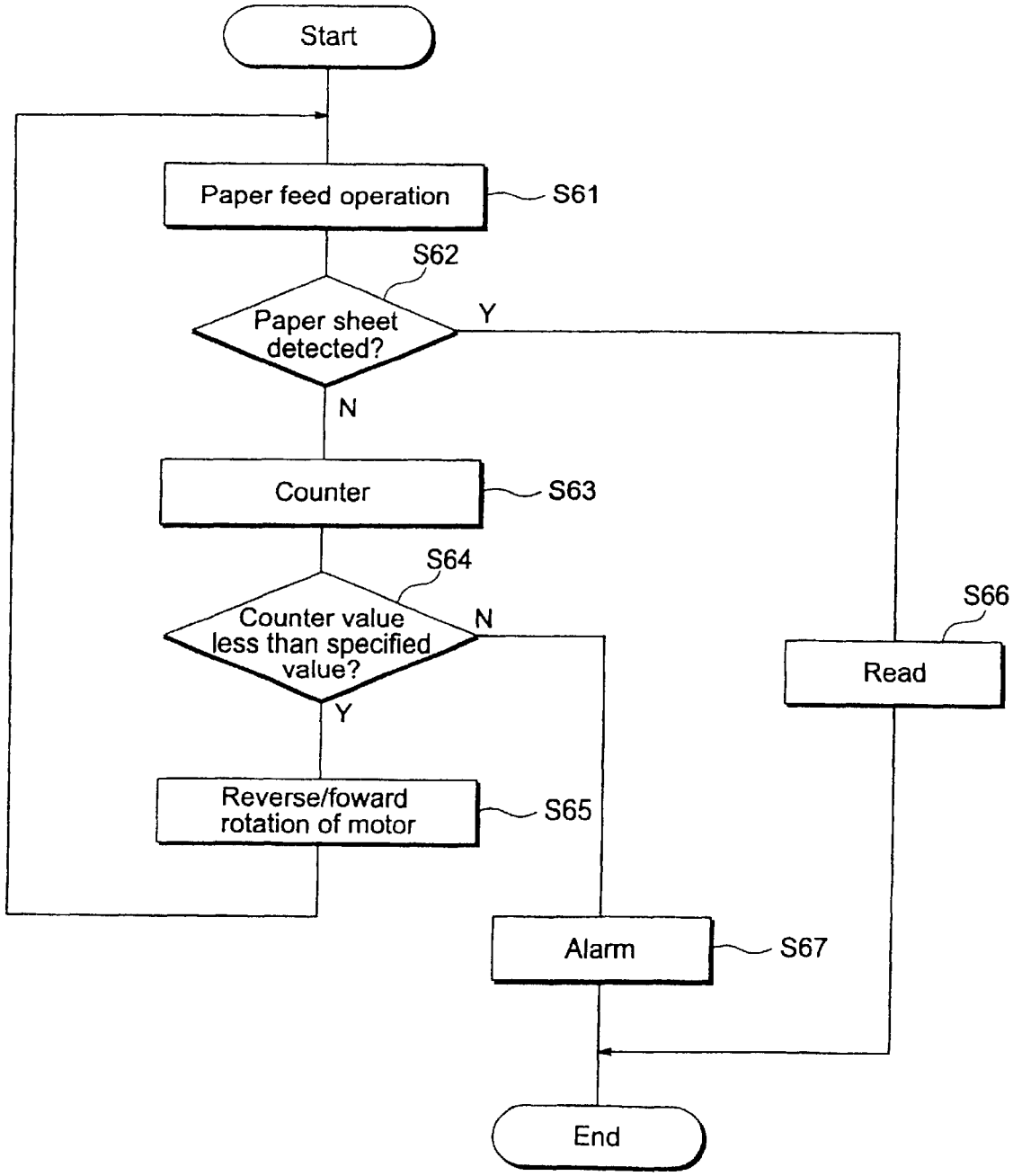

As shown in FIGS. 14 and 19, in a case of controlling the paper feed apparatus according to the present invention (refer to FIG. 4) comprising a pickup mechanism to pick up a plurality of paper sheets stacked on the chute one by one from the bottom and moving them to a predetermined standby position, a pickup arm, which is moved upward when setting paper sheets and downward when feeding the paper sheets, to push from above the paper sheets stacked on the chute, and a paper sheet sensor between pickup/feed rollers for detecting the paper sheet between the pickup and feed rollers in the paper feed path, the controlling method for the paper feed apparatus of the present invention comprises:

detecting the presence/absence of a paper sheet between the pickup and feed roller 1 and 11 in the paper feed path, and executing the operation of jogging the paper sheets stacked on the chute by the pickup arm 4 by repeating the reverse/forward rotation of the motor 6 when no paper sheet is detected between the pickup and feed rollers 1 and 11 in the paper feed path.

With the aforementioned arrangement, paper-sheet pickup performance is improved by detecting whether a paper sheet has been picked up. If the paper sheet has not been picked up, the paper stack on the chute is jogged by the pickup arm.

A recording medium storing a program to realize the control of the paper feed apparatus according to the present invention records a program that can be read by a computer to execute the steps of:

causing the paper feeding motor 6 to forward rotate, based on a paper feed start instruction, to disengage the planetary gear 5 from the pickup arm driving power transmission system, lowering the pickup arm 4 to give the paper sheet an initial transport pressure to start paper feeding; and causing the paper feeding motor 6 to reverse rotate, based on a paper feed end instruction, to engage the planetary gear 5 with the pickup arm driving power transmission system, lifting the pickup arm 4 until the pickup arm sensor 7 detects the pickup arm 4.

This program is stored in a variety of recording media suitable for recording it, such as FDD, CD.

The recording medium storing the program to realize the control of the paper feed apparatus according to the present invention records a program that can be read by a computer to execute the steps of:

temporarily lowering the pickup arm 4 by forward rotating the paper feeding motor 6; and lifting the pickup arm 4 by reverse rotating the paper feed motor 6 after the operation of lowering the pickup arm 4 has been carried out, when lifting the pickup arm after the paper feed apparatus has been initialized or reset.

This program is stored in a variety of recording media suitable for recording it, such as FDD, CD.

The recording medium storing the program to realize the control of the paper feed apparatus according to the present invention records a program that can be read by a computer for carrying out the steps of:

detecting the presence/absence of a paper sheet between the pickup and feed rollers 1 and 11 in the paper feed path during paper feed operation; and jogging the paper stack on the chute 13 by the pickup arm 4 by repeating the reverse/forward rotation of the paper feeding motor 6 when no paper sheets are detected between the pickup and feed rollers 1 and 11 in the paper feed path.

This program is stored in a variety of recording media suitable for recording it, such as FDD, CD.

With this arrangement, the control of the paper feed apparatus according to the present invention can be accomplished using a program for operating a computer, and the program can be stored in various recording media suitable for recording it, such as FDD and CD. Thus, the processing required for controlling the paper feed apparatus according to this invention can be executed by installing the program in any suitable processing device as necessary.

Now, typical embodiments of the present invention will be described, referring to FIGS. 1 to 19. In the following, like reference numerals indicate like parts throughout. Detailed description of them may be omitted in some cases.

Figure 2:
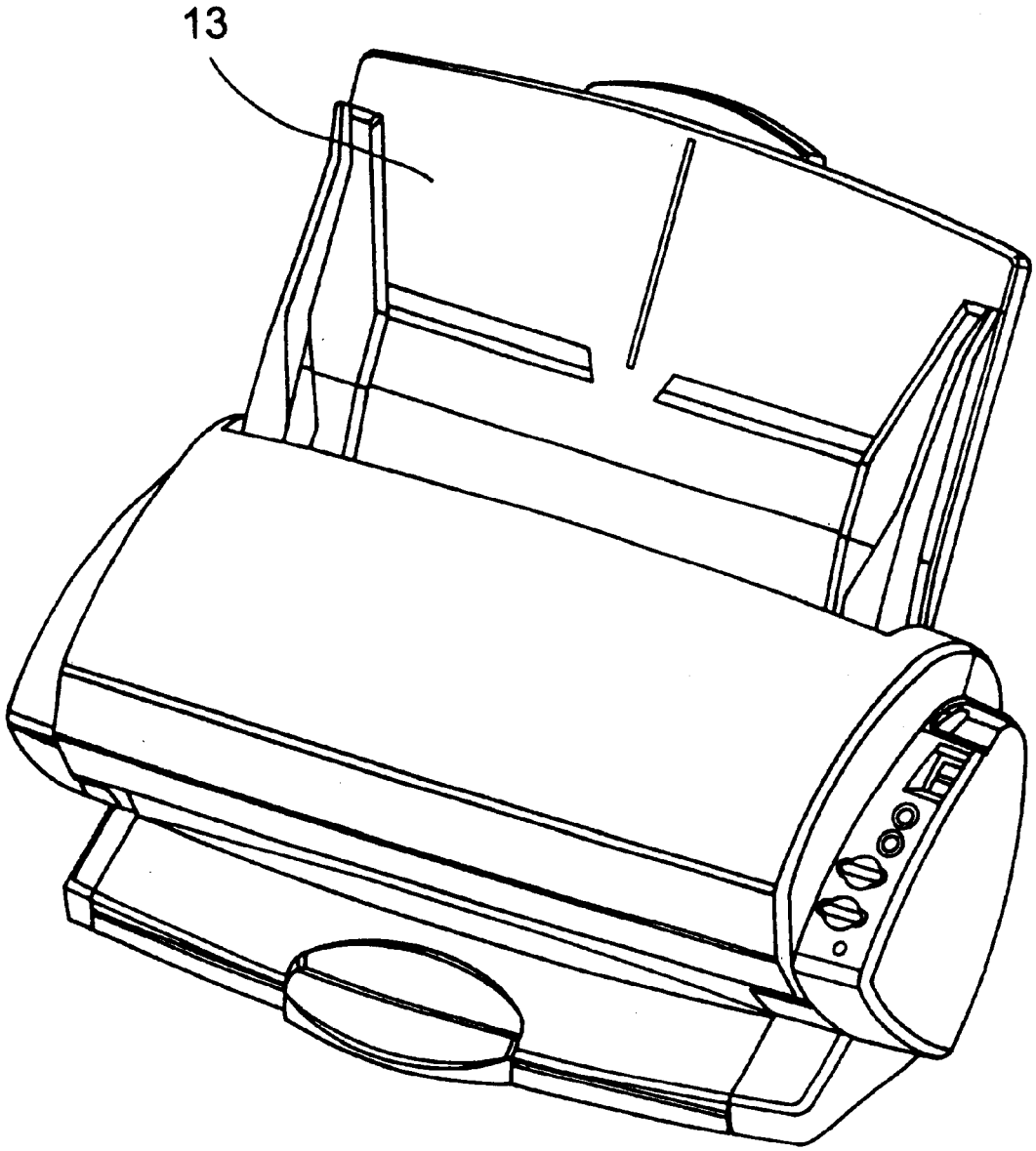
FIG. 2 is an external view of an embodiment of the present invention.

FIG. 2 shows an external appearance of the paper feed apparatus embodying the present invention that is used in an image reader. The image reader has a chute 13 that sets a manuscript being read in the rear part thereof, and a paper feed apparatus inside thereof.

Figure 3:
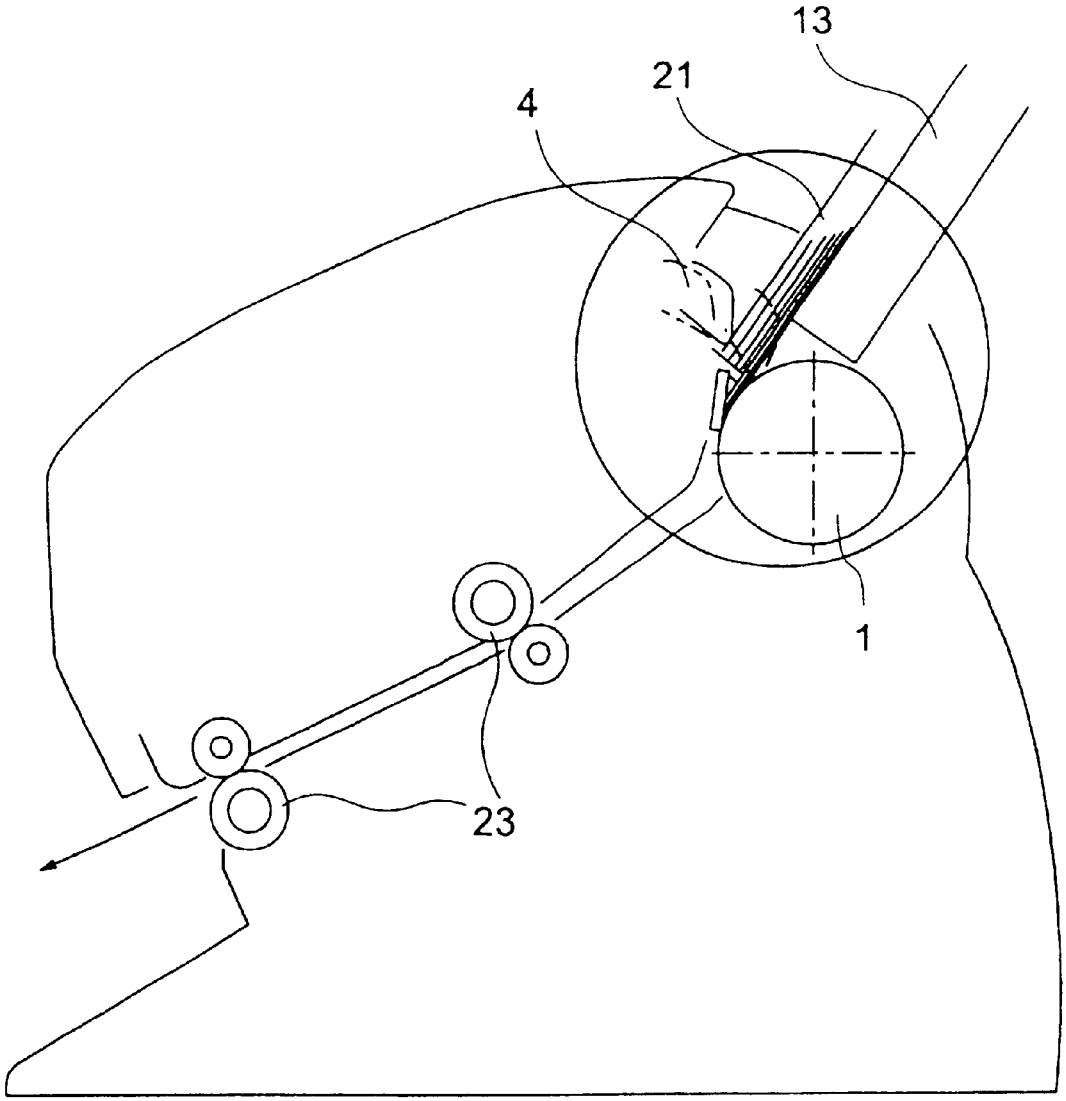
FIGS. 3 through 10 are diagrams showing embodiments of the present invention.

FIG. 3 is a diagram showing the outline of essential parts of the image reader shown in FIG. 1 described above. A pickup mechanism is provided in the vicinity of a paper sheet feeding port of the chute 13, The pickup mechanism picks up a plurality of manuscripts 21 stacked on the chute 13 one by one from the bottom to transport the paper sheets to a predetermined preparatory position.

Next, a typical embodiment will be described in detail.

FIG. 1 shows the details of a paper feed apparatus embodying the present invention. In the figure, numeral 1 refers to a pickup roller, 2 to a gate, 3 to a paper-sheet separating pad, 4 to a pickup arm, and 13 to a chute. A pickup roller 1 is disposed on the underside near the paper feeding port of the chute 13, and a pickup arm 4, a gate 2 and a paper-sheet separating pad 3 are disposed on the upper part of the chute 1 along the paper feed path in that order.

The pickup roller 1 is made of a material having large frictional force, such as foamed rubber. The gate 2 has an about 1 mm-wide clearance C to allow a few sheets of paper to pass between the pickup roller 1 and the gate 2, and is disposed vertically with respect to the direction of paper entry. The paper-sheet separating pad 3 is in sliding contact with the pickup roller 1 to take up a sheet of paper placed on the preparatory position.

The pickup arm 4 is driven in such a manner as to be movable vertically. When setting paper sheets on the chute 13, the pickup arm 4 is moved upward and held at the standby position 4A, when feeding the paper sheet set on the chute 13, moved downward and held at the paper feeding position 4B. Furthermore, the pickup arm 4, when held at the paper feeding position, pushes from above the paper stack on the chute 13 near the paper feed port by a pickup arm pushing force (an arrow A) exerted by a pressure element (not shown).

With the arrangement shown in FIG. 1, paper-sheet separating performance is improved because the gate 2 is disposed vertically with respect to the direction of paper entry, preventing vertical component force from being generated, canceling the force of feed multiple sheets at the gate. Moreover, improved paper-sheet pickup performance allows multiple sheets of paper 90 shown in FIG. 21 (*a*) described above to be set on the chute as they are.

Next, drive systems for paper-sheet transport and the pickup arm will be described.

FIG. 4 shows the details of essential parts of the paper feed apparatus according to the present invention.

Numeral 6 refers to a paper feeding motor driving the pickup roller 1, the feed roller 11 and the feed roller 23 via a gear train to transport paper sheets. A pickup roller driving gear 20 for driving the pickup roller 1 has a one-way clutch and is adapted to rotate only in counterclockwise direction (in the direction of paper transport). Numeral 24 refers to driven rollers disposed to operate in conjunction with the feed rollers 11 and 23. And, numeral 23A refers to gear train.

Numeral 8 refers to a pickup arm driving gear having a rotating fulcrum and is connected to the pickup arm 4. Numeral 5 refers to a planetary gear rotatably connected to a planetary gear frame 26 and adapted to in mesh with the pickup arm driving gear 8. The planetary gear 5 is driven by the rotation of the feed roller 11 via a gear train. Numeral 27 refers to a planetary gear frame stopper for restricting the rotating range of the planetary gear frame 26.

To move the pickup arm 4 downward and held at the paper feeding position, the motor 6 is reverse rotated to disengage the planetary gear 5 from the pickup arm driving gear 8, causing the pickup arm 4 to move downward. To move the pickup arm 4 upward and held at the standby position, on the other hand, the motor is reverse rotated to engage the planetary gear 5 with the pickup arm driving gear 8, causing the pickup arm 4 to move upward. Details of the operation of the planetary gear-based clutch mechanism will be described later.

Now, we will describe the construction of the pickup arm 4, digressing from the embodiment shown in FIG. 4.

Figure 20:
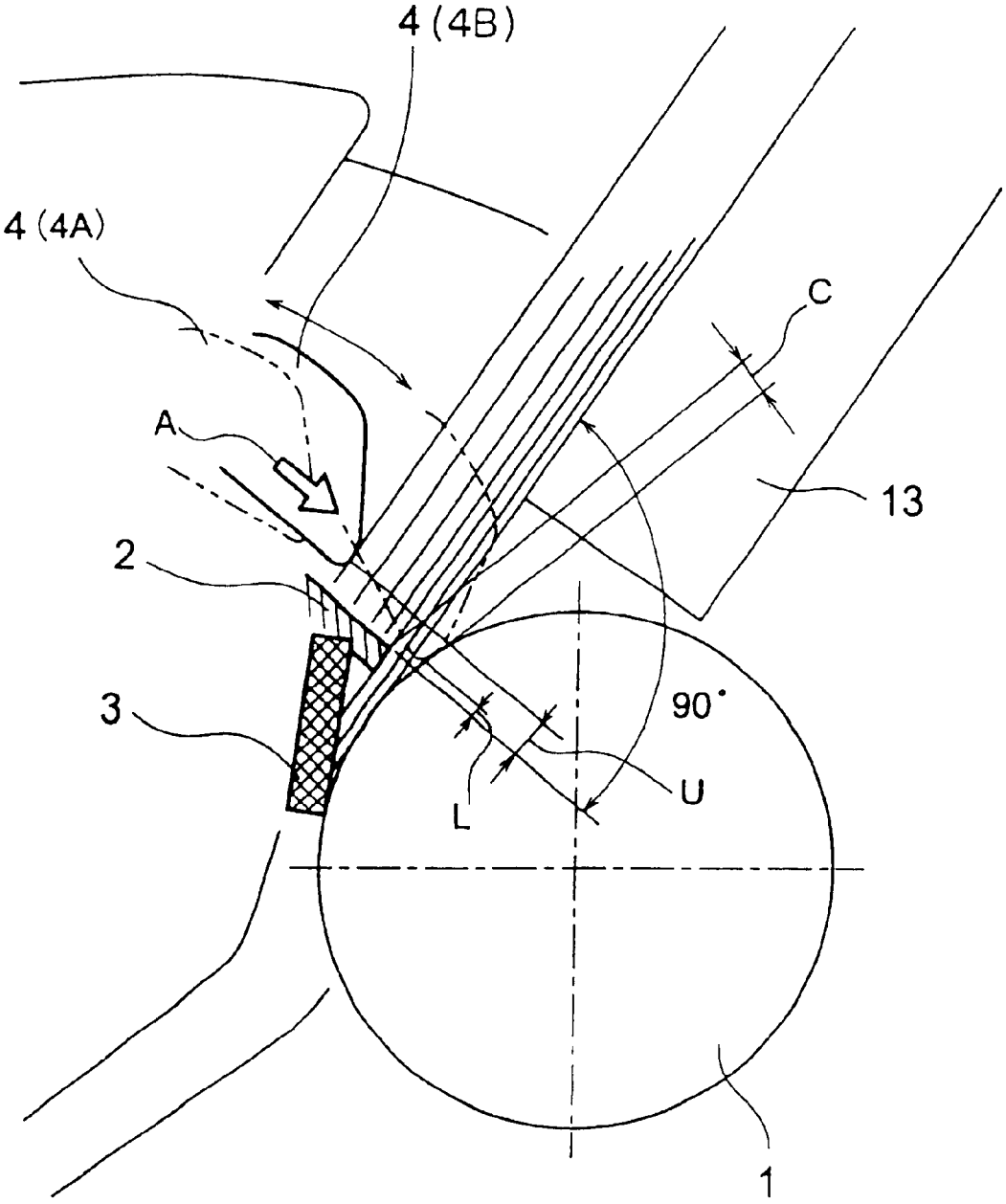
FIGS. 20 through 26 are diagrams showing embodiments of the present invention.

The rotating fulcrum of the pickup arm 4 is provided at such a location that the tip of the pickup arm 4 is moved in such a manner as shown in FIG. 20. That is, as the number of sheets of the manuscript 21 stacked on the chute 13 increases, the rotating fulcrum of the pickup arm 4 is set at such a location that when the number of sheets of the manuscript 21 stacked on the chute 13 increases, the pickup arm 4 is moved in such a manner that the tip of the pickup arm 4 pushes the manuscript 21 at a location away from the gate 2. And, position L refers to lower point of pushing position, and position U to upper point of pushing position.

When the number of sheets of the manuscript 21 stacked on the chute 13 is small, the tip of the pickup arm 4 (the pressure point at which the pickup arm 4 pushes the paper sheets) should preferably be located nearer to the gate to prevent edges of the manuscript 21 from curling.

When the number of sheets of the manuscript 21 stacked on the chute 13 is large, on the other hand, there is no problem theoretically even if the tip of the pickup arm 4 is moved away from the gate 2 because the upper part of the manuscript 21 pushes the lower part of the manuscript 21 by its own weight. When the number of sheets of the manuscript 21 is large, however, edges of the manuscript 21 are not necessarily aligned neatly, depending on the way the user sets paper sheets on the chute. For this reason, as the tip of the pickup arm 4 detaches away from the gate 2, the upper part of the manuscript 21 deviates from the pressure point, leading to failure to pick up the upper part of the manuscript 21.

This invention, therefore, employs a construction in which the rate of successful paper pickup against user's paper-sheet setting can be improved while preventing paper curling by setting the rotating fulcrum of the pickup arm 4 at such a location that the pickup arm 4 is moved in such a manner that the tip of the pickup arm 4 pushes the manuscript 21 at a location away from the gate 2, as the number of sheets of the manuscript 21 stacked on the chute 13 increases.

Figure 21:
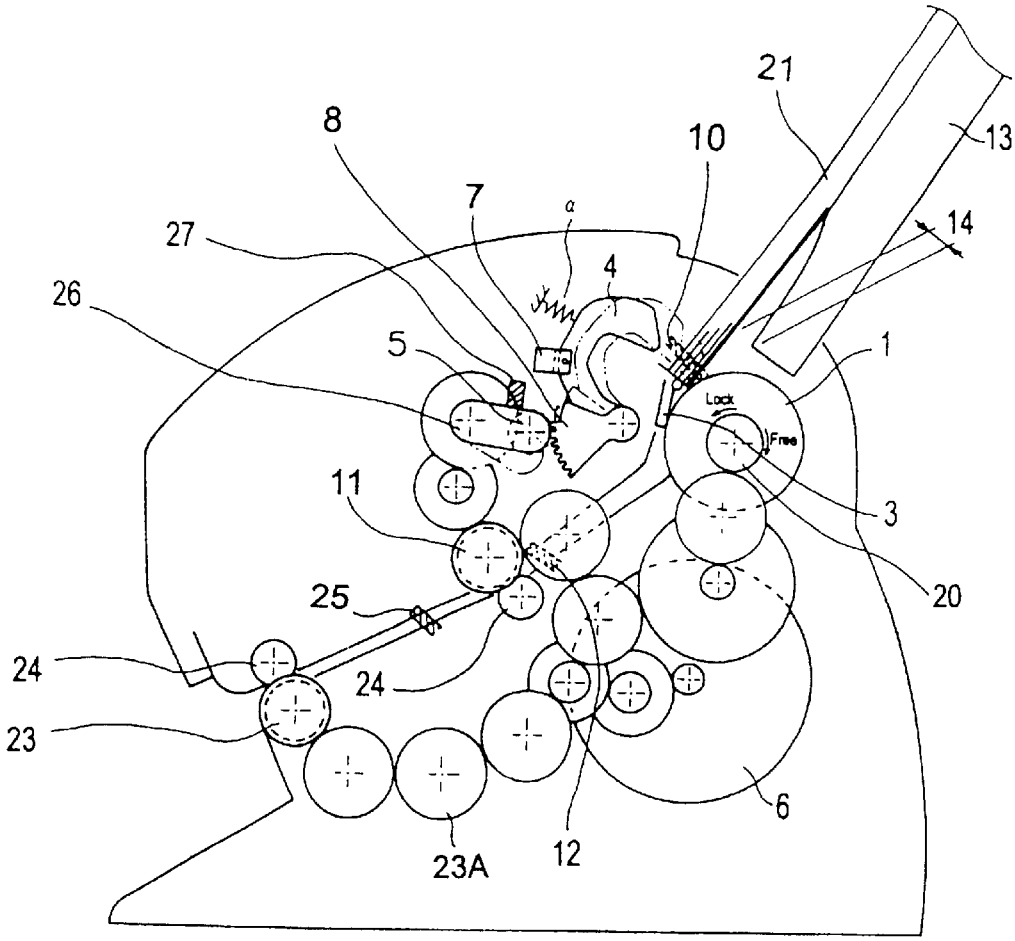
Figure 22:
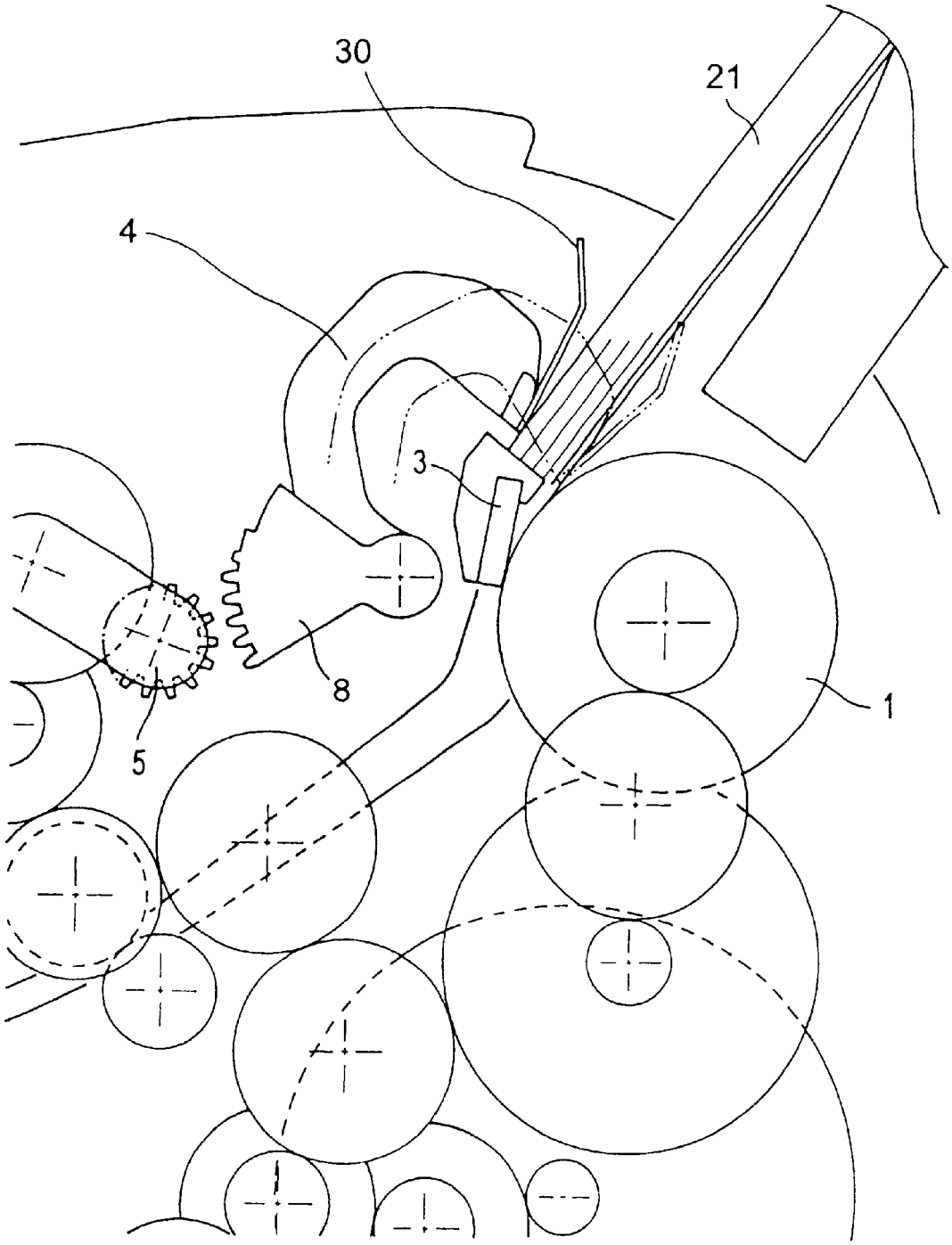

As described above, when the motor 6 is forward rotated in the direction of paper transport, the planetary gear 5 is disengaged from the pickup arm driving gear 8 to put the pickup arm 4 in free state. At this time, the tip of the pickup arm 4 is forced onto the manuscript 21 by a helical torsion spring (though not shown in FIG. 4) provided on the rotating shaft of the pickup arm 4, as shown in FIG. 21 (where a spring a shown in the figure indicates the action of the helical torsion spring).

That is, when the tip of the pickup arm 4 is in the upper part (when the number of paper sheets of the manuscript 21 stack on the chute is large), the tip of the pickup arm 4 pushes the manuscript 21 by a relatively large force, while the tip of the pickup arm 4 pushes the manuscript 21 by a relatively small force when the tip of the pickup arm 4 is in the lower part (when the number of paper sheets of the manuscript 21 stacked on the chute 13 is small).

As is evident from FIG. 20, paper feeding is accomplished in the present invention by generating a paper transport force as the lowermost part of the manuscript 21 is forced onto the pickup roller 1 when the pickup arm 4 pushes the upper part of the manuscript 21. In actual practice, however, the pushing force of the pickup roller 1 may be reduced due to the upward curling of the manuscript 21. This may cause a difference in paper transport force, depending on whether the number of paper sheets of the manuscript 21 is large or small. That is, when the number of paper sheets of the manuscript 21 is large, paper transport force is low, resulting errors in paper sheet pickup, whereas when the number of paper sheets of the manuscript 21 is small, paper transport force is high, resulting in multiple-sheet feeding.

The normal practice to prevent this is to set the pushing force of the pickup arm 4 to a higher level, and to set paper-sheet separating force to a higher level to prevent multiple-sheet feeding. Following this practice, however, could cause the problem of frequent jamming when feeding thin paper sheets of the manuscript 21 because excessive force tends to be exerted onto the manuscript 21, and the problem of increased power consumption could result due to the increased torque of the motor 6.

To cope with these problems, the present invention employs a construction where the rate of successful paper pickup for thin paper sheets is improved and the power consumption of the motor is reduced by pushing the manuscript 21 with a large force using a helical torsion spring, etc. when the tip of the pickup arm 4 is moved upward (when the number of paper sheets of the manuscript 21 stacked on the chute 13 is large), while pushing the manuscript 21 with a small force when the tip of the pickup arm 4 is moved downward (when the number of paper sheets of the manuscript 21 stacked on the chute 13 is small).

Assuming that the pushing force of the pickup arm 4 is expressed by P, the allowable amount of paper curling of the manuscript 21 by b, the paper strength of the manuscript 21 by k, the number of paper sheets of the manuscript 21 stacked on the chute 13 by x, and the initial pushing force by C, the following relation holds:

$$P=b\times k\times x+C.$$

The helical torsion spring provided on the rotating shaft of the pickup arm 4 is therefore designed by taking this equation into consideration.

In accordance with the construction of the present invention, when the manuscript 21 on the chute 13 is pushed by the pickup arm 4, the manuscript 21 may be lifted near the gate 2. To cope with this, therefore, a paper retaining sheet 30 made of a resilient material having such a shape as to prevent the upward warping of the manuscript 21 should preferably be provided at the tip of the pickup arm 4.

Now, let's get back to the description of the embodiment shown in FIG. 4.

Numeral 7 refers to a pickup arm sensor for detecting that the pickup arm 4 is moved to the upper part as the motor 6 is reverse rotated to cause the planetary gear 5 to be in mesh with the pickup arm driving gear 8. As a result, the pickup arm 4 is moved to the upper part as the motor 6 is reverse rotated until the pickup arm sensor 7 transmits a signal for detecting the pickup arm 4 (ON).

Numeral 10 refers to a chute-mounted paper-sheet sensor that is installed in such a positional relationship that the sensor 10 stays in OFF state even when the manuscript 21 is set on the chute 13 in the state where the pickup arm 4 is moved downward, and the sensor 10 is changed to ON state when the manuscript 21 is set on the chute 13 in the state where the pickup arm 4 is moved upward. This allows the paper feed apparatus according to the present invention not to execute the operation of lifting the pickup arm 4 so long as the chute-mounted paper-sheet sensor 10 keeps transmitting a signal indicating that the sensor 10 detects the presence of paper sheets after the paper feed apparatus has been initialized or reset.

Numeral 12 refers to a paper-sheet sensor between pickup/feed rollers for detecting the presence/absence of paper sheets between the pickup and feed rollers 1 and 11 in the paper feed path. With this arrangement, as long as the paper-sheet sensor 12 between pickup/feed rollers keeps transmitting a signal indicating that the sensor does not detect the presence of paper sheets, that is, as long s no paper sheets are not picked up, the motor 6 repeats the reverse/forward rotation to cause the pickup arm 4 to move up and down to jog paper sheets stack on the chute 13.

Numeral 25 refers to a paper leading end/trailing end sensor for detecting the leading end and trailing end of a paper sheet. As the paper leading end/trailing end sensor 25 detects the leading end of a paper sheet, and transmits a signal, reading is started. And, when the paper leading end/trailing end sensor 25 detects the trailing end of a paper sheet, reading is ended, and the paper sheet is discharged by a feed roller 23 to a stacker (not shown), or to the outside of the paper feed apparatus.

Furthermore, the chute 13 has a shouldered part 14 that is inclined toward the direction of paper entry by slightly lowering the level of the chute near the paper feed port.

Next, details of a planetary gear-based clutch mechanism using the planetary gear 5.

FIG. 5 shows an embodiment of the present invention. In the figure, when the pickup arm 4 is moved downward to set the paper feeding position, the motor 6 is rotated in forward direction. At this time, the pickup roller 1 is rotated counterclockwise (in the direction of paper transport) by a gear train 23A, while the feed roller 11 is rotated clockwise (in the direction of paper transport) by the gear train 23A. The planetary gear 5 in the standby position 5A is driven by the rotation of the feed roller 11 via the gear train to rotate counterclockwise on its own axis, and start making an orbital motion in the clockwise direction while engaging with the pickup arm driving gear 8. Furthermore, the planetary gear 5 that has started making an orbital motion is disengaged from the pickup arm driving gear 8, moving to the paper feeding position 5B. At this time, the pickup arm 4 connected to the pickup arm driving gear 8 is moved downward by the pickup arm pushing force exerted by the pressure element described in reference to FIG. 21, pushing from above the paper stack on the chute 13 near the paper feed port. And, numeral 15 refers to a rotating fulcrum of a gate/pad assembly 15A, and arrow A shows direction of forward rotation of the motor 6.

To move the pickup arm 4 upward and hold at the standby position, on the other hand, the motor 6 is reverse rotated. At this time, the feed roller 11 is rotated counterclockwise by the gear train. The pickup roller 1 is not rotated because the pickup roller driving gear 20 has a one-way clutch. The planetary gear 5 is driven by the rotation of the feed roller 11 via the gear train to rotate clockwise on its own axis and start making an orbital motion in the counterclockwise direction. Furthermore, the planetary gear 5 that has started an orbital motion starts engaging with the pickup arm driving gear 8. The pickup arm driving gear 8 in mesh with the planetary gear 5 start rotating counterclockwise, whereas the pickup arm 4 connected to the pickup arm driving gear 8 also starts moving upward. The pickup arm 4 is moved upward by reverse rotating the motor 6 until the pickup arm sensor 7 transmits a signal indicating that the pickup arm 4 has been detected (ON).

In the construction of FIGS. 4 and 5, the paper feed motor 6 is used as a drive source for both transporting paper sheets and moving the pickup arm 4. This helps reduce the number of component parts and make the paper feed apparatus compact in size. Although the planetary gear frame 26, which operates by frictional force, tends to cause erratic delays in operation, the pickup arm sensor 7 accurately detects the movement of the pickup arm 4. When the paper sheet sensor 12 between pickup/feed rollers detects that a paper sheet has not been picked up, the pickup arm 4 is caused to jog edges of paper sheets. This leads to improved paper pickup performance. The shouldered part 14 provided on the chute makes the paper stack cantilevered, thereby reducing the resistance of the paper stack to the pushing force exerted by the pickup arm. With this arrangement, even with upwardly curled paper sheets, the pressure exerted by the pickup arm onto the paper stack can be transmitted accurately to the pickup roller, leading to improved paper pickup performance.

Next, description will be made about the case where there are no means for detecting the operation of the pickup arm 4.

FIG. 6 is a diagram illustrating an embodiment of the present invention. The embodiment shown in FIG. 6 is exactly the same as that shown in FIG. 5, except that the pickup arm sensor 7 shown in FIG. 5 is not provided in FIG. 6.

FIG. 7 shows an embodiment of the present invention. In the figure, the pickup arm driving gear 8 for driving the pickup arm 4 by engaging with the planetary gear 5 has a cut-tooth portion 9 formed by removing part of teeth of the pickup arm driving gear 8 by the depth of the addendum circle 51 of the planetary gear 5.

When the planetary gear-based clutch mechanism has no means for detecting the movement of the pickup arm 4, an arrangement must be provided so that operation can allow for the possible erratic delays caused by the planetary gear frame 26. To achieve this, the movable range of the pickup arm 4 must be increased. This, however, could increase the size of the pickup arm 4. To make the pickup arm compact, it is desirable to reduce the number of teeth of the pickup arm driving gear 8 to the required minimum, increase the number of pulses for the reverse rotation of the drive motor, and when there are few delays, cause tooth skips to prevent the pickup arm 4 from being excessively lifted. This could also generate tooth skipping noise (tooth rasping noise) that gives the user discomfort. With the aforementioned arrangement, strokes for causing tooth skips can be reduced, thereby reducing tooth skipping noise (tooth rasping noise). That is, tooth rasping noise can be reduced since the planetary gear 5 engages with the pickup arm driving gear 8 in half strokes, not in full strokes.

Next, the gate 2 and the paper-sheet separating pad 3 will be described.

As shown in FIGS. 5 and 6, the gate 2 is integrally formed with a member for mounting the paper-sheet separating pad 3, such as an integrally molded gate subassembly 29 shown in FIG. 8, for example. On an end of a member integrally formed into the gate and the paper-sheet separating pad provided is a rotating fulcrum 15 almost in alignment with the tip of the gate 2, while the other end thereof exerts pressure in the direction of the pickup roller 1 by the paper-sheet separating pressure imparting spring 16.

With this arrangement, the distance X from the gate 2 to the paper-sheet separating pad 3 can be reduced to the minimum, and as a result, the possible curling of paper ends between the gate 2 and the paper-sheet separating pad 3 can also be reduced to the minimum. Thus, paper feeding performance can be improved and both the gate 2 and the paper-sheet separating pad 3, and accordingly the entire paper feed apparatus assembly, can be made compact in size. Moreover, since the rotating fulcrum is in alignment with the gate tip, a constant gate gap can be maintained regardless of variations in the thickness of the paper-sheet separating pad and the friction caused by the paper-sheet separating pad during paper feeding. This leads to stabilized paper feeding performance.

FIGS. 8 to 10 are diagrams showing an embodiment of the present invention; FIG. 8 an exploded perspective view, FIG. 9 a perspective view, and FIG. 10 a cross-sectional view of the gate/pad assembly, respectively.

In FIG. 8, an integrally molded gate subassembly 29 is molded by resin molding into such a molding that the gate 2 is included and the paper-sheet separating pad 3 and the pad retaining wire spring 17 can be mounted thereon subsequently. The pad retaining wire spring 17 is made of a thin wire and mounted on the paper-sheet separating pad 3 by passing through through-holes (not shown). In FIGS. 9 and 10, the paper-sheet separating pad 3 is mounted on the gate/pad assembly 29 by installing the pad retaining wire spring 17 near the gate 2 and passing the spring 17 through through-holes provided near the gate 2.

Since this arrangement allows mechanical fixation to be achieved within a limited range, the gate 2 and the paper-sheet separating pad 3, and accordingly the entire paper feed apparatus assembly, can be made compact in size. In addition, this arrangement can prevent the paper-sheet separating pad 3 from being peeled off, leading to stabilized paper-sheet separating performance. Installation of the papersheet separating pad 3 using the pad retaining wire spring 17 need not drying time, as in the case where adhesive is used, thus enabling quick assembly.

Next, the operation of the pickup arm sensor in the paper feed apparatus embodying this invention (refer to FIG. 5) will be described in the following.

FIG. 11 is a block diagram showing an embodiment of the present invention. FIG. 15 is a flow chart showing the operation of the pickup arm during paper feeding. And, FIG. 16 is a flow chart showing the operation of the pickup arm at the end of paper feeding operation.

In FIG. 11, an image reader 50 comprises an arithmetic and control section 51, a drive section 52, a drive system 53 and a pickup arm sensor 7. The arithmetic and control section 51 gives instructions to the drive section 52 at the correct time on the basis of instructions given by the host unit 60 and outputs from the pickup arm sensor 7.

Now, description will be made on the flow chart of the embodiment of the present invention in FIG. 15.

In Step 11, when a manuscript being read is set on a predetermined position of the chute and an instruction to start reading is issued by the host unit 60, the arithmetic and control section 51 issues an instruction to start paper feeding to the drive section 52. In Step 12, the drive section 52 forward rotate the paper feed motor 6 (counterclockwise). (Refer to FIG. 5.) In Step 13, the feed roller 11 rotates in the direction of paper feed (clockwise). (Refer to FIG. 5.) In Step 14, the planetary gear 5 is disengaged from the pickup arm driving gear 8 (refer to FIG. 4). In Step 15, the pickup arm 4 is lowered by the pressure exerted by the pickup arm pressure element. In Step 16, the pickup arm 4 is forced by the pushing force of the pickup arm pressure element onto the paper sheet set at a predetermined location of the chute to apply an initial transport pressure. In Step 17, paper feeding is started by the rotation of the pickup roller 1, and the processing is terminated.

Now, the flow chart of the embodiment of the present invention shown in FIG. 16 will be described.

In Step 21, the arithmetic and control section 51 instructs the drive section 52 to terminate paper feeding. In Step 22, the drive section 52 causes the paper feed motor 6 to reverse rotate (clockwise). In Step 23, the feed roller 11 reverse rotate with respect to the direction of paper feeding (counterclockwise). In Step 24, the planetary gear 5 engages with the pickup arm driving gear 8. In Step 25, the pickup arm 4 moves upward. In Step 26, the arithmetic and control section 51 judges whether the pickup arm sensor 7 (refer to FIG. 5) has detected the pickup arm 4. If it the pickup arm 4 has been detected, the processing proceeds to Step 27, and if not, the processing is returned to Step 22. In Step 27, the motor 6 is stopped to hold the pickup arm 4 at the standby position and the processing is terminated.

Next, the operation of bringing the pickup arm to the standby position in the case where the pickup arm sensor in the paper feed apparatus according to the present invention (refer to FIG. 6) will be described.

FIG. 12 is a block diagram showing the embodiment of the present invention, and FIG. 17 is a flow chart of the embodiment of the present invention, respectively.

In FIG. 12, the image reader 50 comprises an arithmetic and control section 51, a drive section 52 and a drive system 53. The arithmetic and control section give instructions, including those from the host unit 60, to the drive section 52 at the correct time.

The processing procedures will be described in the following, referring to FIG. 17.

In Step 41, the paper feed apparatus is initialized or reset by turning on the power, releasing paper jam, terminating paper feeding and other processing. In Step 42, the arithmetic and control section 51 instructs the drive section 52 to lift the pickup arm 4 to move to the standby position. In Step 43, the drive section 52 lowers the pickup arm 4 by temporarily forward rotating the paper feed motor 6 by the required amount to lower the pickup arm 4 (refer to FIG. 6). In Step 44, after having executed the operation to lower the pickup arm 4, the drive section 52 reverse rotates the motor 6 to the required amount to lift the pickup arm 4. In Step 45, the pickup arm 4 is lifted and held at the standby position, and the processing is terminated.

When the means for detecting the operation of the pickup arm 4 is not provided with this arrangement, it is necessary to adopt a function of preventing the pickup arm from excessively lifting to make the pickup arm compact. Using this processing, tooth skipping noise (tooth rasping noise) can be eliminated without the need for the pickup arm sensor.

Next, the operation of bringing the pickup arm 4 to the standby position in the case where a pickup arm sensor is deleted (refer to FIG. 6) and a chute-mounted paper-sheet sensor (refer to FIG. 4) is provided in the paper feed apparatus according to the present invention will be described.

FIG. 13 is a block diagram showing the embodiment of the present invention, and FIG. 18 is a flow chart of the embodiment of the present invention, respectively.

In FIG. 13, the image reader 50 comprises an arithmetic and control section 51, a drive section 52, a drive system 53 and a chute-mounted paper-sheet sensor 10. The arithmetic and control section 51 instructs the drive section 52 at the correct time on the basis of instructions from the host unit 60 and output from the chute-mounted paper-sheet sensor 10.

The processing procedures will be described in the following, referring to FIG. 18.

In Step 51, the paper feed apparatus is initialized or reset by turning on the power the paper feed apparatus, releasing paper jam, terminating paper feeding and other processing. In Step 52, the arithmetic and control section 51 instructs the drive section 52 to lift the pickup arm 4 to move to the standby position. In Step 53, the arithmetic and control section 51 judges whether the chute-mounted paper-sheet sensor 10 has detected a paper sheet. If the paper sheet has been detected, the processing is terminated, and if not, the processing proceeds to Step 54. In Step 54, the drive section 52 lowers the pickup arm 4 by forward rotating the paper feed motor 6 by the required amount to lower the pickup arm 4 (refer to FIG. 6). In Step 55, after having executed the operation to lower the pickup arm 4, the drive section 52 reverse rotates the motor 6 by the required amount to lift the pickup arm 4. In Step 56, the pickup arm 4 is lifted and held at the standby position, and the processing is terminated.

That is, the operation of lifting the pickup arm 4 is not executed when the chute-mounted paper-sheet sensor 10 that is installed in such a manner that the sensor 10 does not detect the paper even if the paper is set on the chute so long as the pickup arm 4 is moved downward, and the sensor 10 detects, the paper if the paper is set on the chute in the state where the pickup arm 4 is moved upward.

With this arrangement, even when the paper feed apparatus is initialized or reset in the state where the paper is set on the chute, the paper is prevented from being taken into the paper feed path.

Next, the processing procedures in the case where a paper-sheet sensor between pickup/feed rollers (refer to FIG.

4) is provided in the paper feed apparatus according to the present invention will be described in the following.

FIG. 14 is a block diagram showing an embodiment of the present invention, and FIG. 19 is a flow chart of an embodiment of the present invention.

In FIG. 14, the image reader comprises an arithmetic and control section 51, a drive section 52, a drive system 53, a paper-sheet sensor 12 between pickup/feed rollers, and a reading section 54. The arithmetic and control section 52 instructs the drive section 52 at the correct time on the basis of instructions from the host unit 60 and outputs from the paper-sheet sensor 12 between pickup/feed rollers. The arithmetic and control section 52 gives a read instruction to the reading section 54 and acquires data on read image to transmit the image data to the host unit 60.

Processing procedures will be described, referring to FIG. 19.

In Step 61, the drive section 52 executes paper feeding operation on the basis of instructions from the arithmetic and control section 5 1. In Step 62, the arithmetic and control section 51 judges whether the paper-sheet sensor 12 between pickup/feed rollers has detected the paper sheet between the pickup and feed rollers 1 and 11 in the paper feed path. If the paper has been detected, the processing proceeds to Step 66, and if not, proceeds to Step 63. In Step 63, the arithmetic and control section 51 counts by a counter the number of retries of reverse/forward rotation of the motor 6, which will be described later. In Step 64, the arithmetic and control section 51 judges whether the number of retries counted by the counter is less than the specified value. If it is less than the specified value, the processing proceeds to Step 65, and if not, proceeds to Step 67. In Step 65, the drive section 52 executes the operation of reverse/forward rotating the motor 6, and the processing is returned to Step 61. In Step 66, the arithmetic and control section 5 executes reading operation by driving the image reader 50, and the processing is terminated. In Step 67, the arithmetic and control section 51 issues an alarm to the image reader 50 or the host unit 60, and the processing is terminated.

That is, the paper feed apparatus according to the present invention has the procedure for jogging the paper stack on the chute by the pickup arm 4 by repeatedly reverse/forward rotating the motor 6 when no paper sheet is detected between the pickup and feed rollers 1 and 11 in the paper feed path.

With this arrangement, paper-sheet pickup performance can be improved because the paper feed apparatus detects whether paper sheets are picked up, and if paper sheets are not picked up, the operation of jogging the paper stack on the chute is carried out.

The aforementioned control processing in the paper feed apparatus is accomplished using a computer program. This program is stored in FDD, CD or various other adequate types of recording media.

Figure 23:
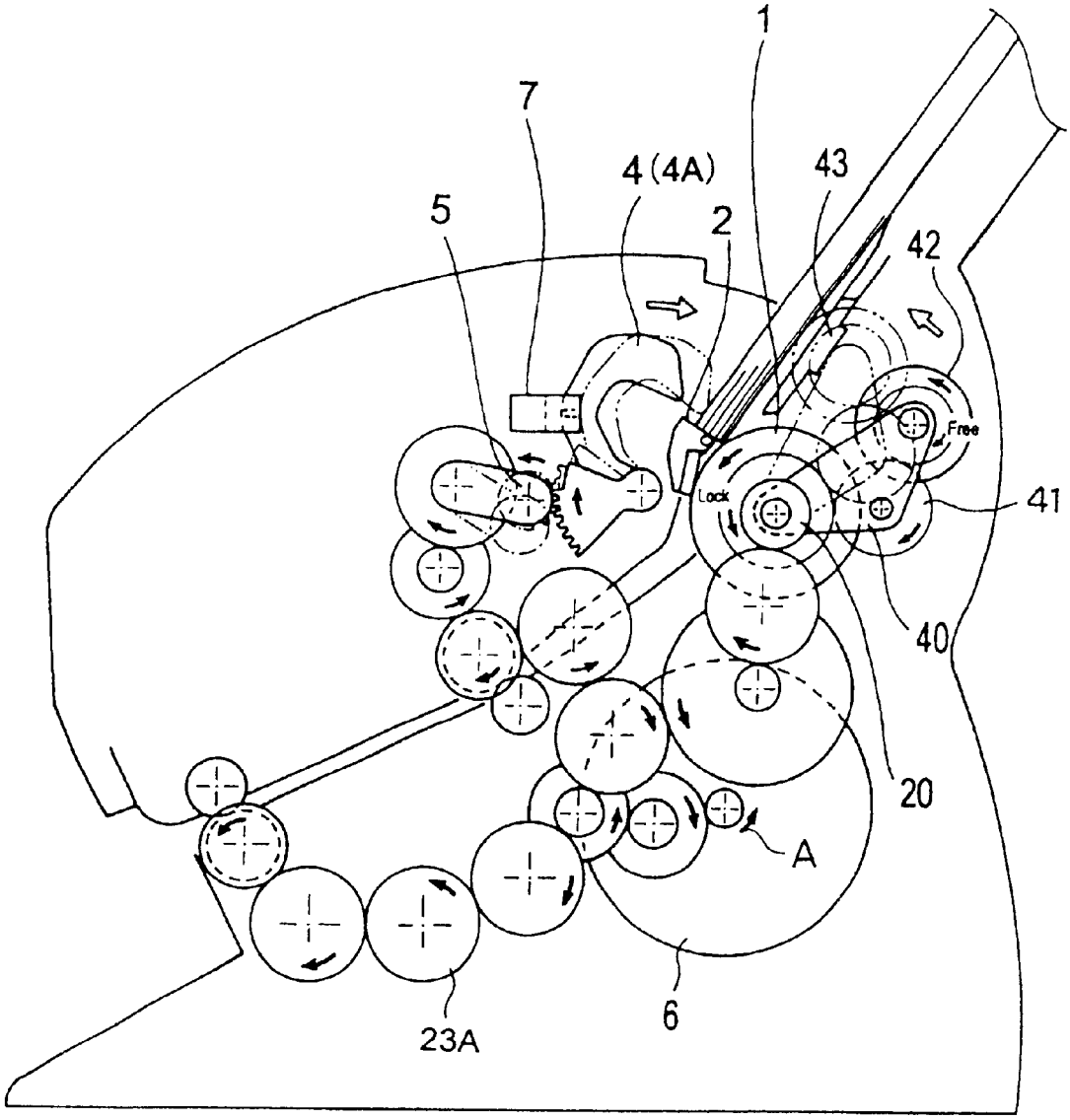

FIG. 23 shows another embodiment of the present invention. In this embodiment, a pre-pickup unit 40 that is rotatable around the pickup roller driving gear 20 as the rotating center is provided to improve paper-sheet pickup performance, in addition to the basic construction used in the embodiment shown in FIG. 4. In this embodiment, the pickup roller driving gear 20 does not have a one-way clutch, unlike the embodiment shown in FIG. 4. but the pickup roller 1 has inside thereof a one-way clutch that can rotate only counterclockwise (in the direction of paper feed).

This pre-pickup unit 40 comprises an idle gear 41 enmeshed with the pickup roller driving gear 20, and a pre-pickup roller 42 enmeshed with the idle gear 41, and has such a construction that the pre-pickup unit 40 can be rotated around the pickup roller driving gear 20. by the rotation of the pickup roller driving gear 20, and the counterclockwise rotation thereof is stopped by a stopper 43. At the location at which the pre-pickup unit 40 stops, the pre-pickup roller 42 transports the manuscript 21 stacked on the chute 13 to the gate 2 by pre-picking up the manuscript 21 from the rear surface.

The pre-pickup roller 42 rotates at a slower peripheral speed than the peripheral speed of the pickup roller 1 to realize the smooth transport of the manuscript 21, and has inside thereof a one-way clutch that can rotate only counterclockwise (in the direction of paper feed), taking into consideration the likelihood that the pre-pickup roller 42 is governed by the peripheral speed of the pickup roller 1 during the transport of the manuscript 21.

When the pickup roller driving gear 20 is rotated counterclockwise (in the direction of paper feed), the idle gear 41 makes an orbital motion counterclockwise while rotating around its own axis clockwise, working with the pickup roller driving gear 20. This causes the pre-pickup unit 40 to rotate counterclockwise and the pre-pickup roller 42 to move to the pre-picking position and rotate counterclockwise (in the direction of paper feed). When the pickup roller driving gear 20 is rotated clockwise, the idle gear 41 makes an orbital motion clockwise while rotating around its own axis counterclockwise, working with the pickup roller driving gear 20. This causes the pre-pickup unit 40 to rotate clockwise and the pre-pickup roller 42 to move to the specified original position away from the pre-pickup position.

In the embodiment shown in FIG. 23 where the pre-pickup unit 40 having the aforementioned construction is provided, the pickup roller driving gear 20 is rotated counterclockwise as the motor 6 forward rotates in the direction of paper feed. This causes the pre-pickup unit 40 to rotate counterclockwise up to the position defined by the stopper 43, at which the pre-pickup roller 42 pre-picks up the manuscript 21 stacked on the chute 13 from the rear surface to transport to the gate 2.

As the motor 6 is reverse rotated, the pickup roller driving gear 20 is rotated clockwise. This causes the pre-pickup unit 40 to rotate clockwise, and operate in such a manner as to release the pre-pickup processing by the pre-pickup roller 42. At this time, the pickup roller 1 is put into free state by the one-way clutch provided inside thereof.

In the embodiment shown in FIG. 23, the rotation of the pickup roller driving gear 20 is transmitted to the pre-pickup roller 42 using the idle gear 41. With this arrangement, however, it is necessary to provide a one-way clutch in the pre-pickup roller 42 so as to accurately transmit the rotation of the pickup roller driving gear 20 to the pre-pickup roller 42. That is, the peripheral speed of the pre-pickup roller 42 is governed by the peripheral speed of the pickup roller 1 during the transport of the manuscript 21. To permit this, therefore, a one-way clutch must be provided in the pre-pickup roller 42.

When a one-way clutch is provided in the pre-pickup roller 42, as in the case of the embodiment shown in FIG. 23, the construction of the pre-pickup roller 42 could become complex and manufacturing cost could be increased.

Figure 24:
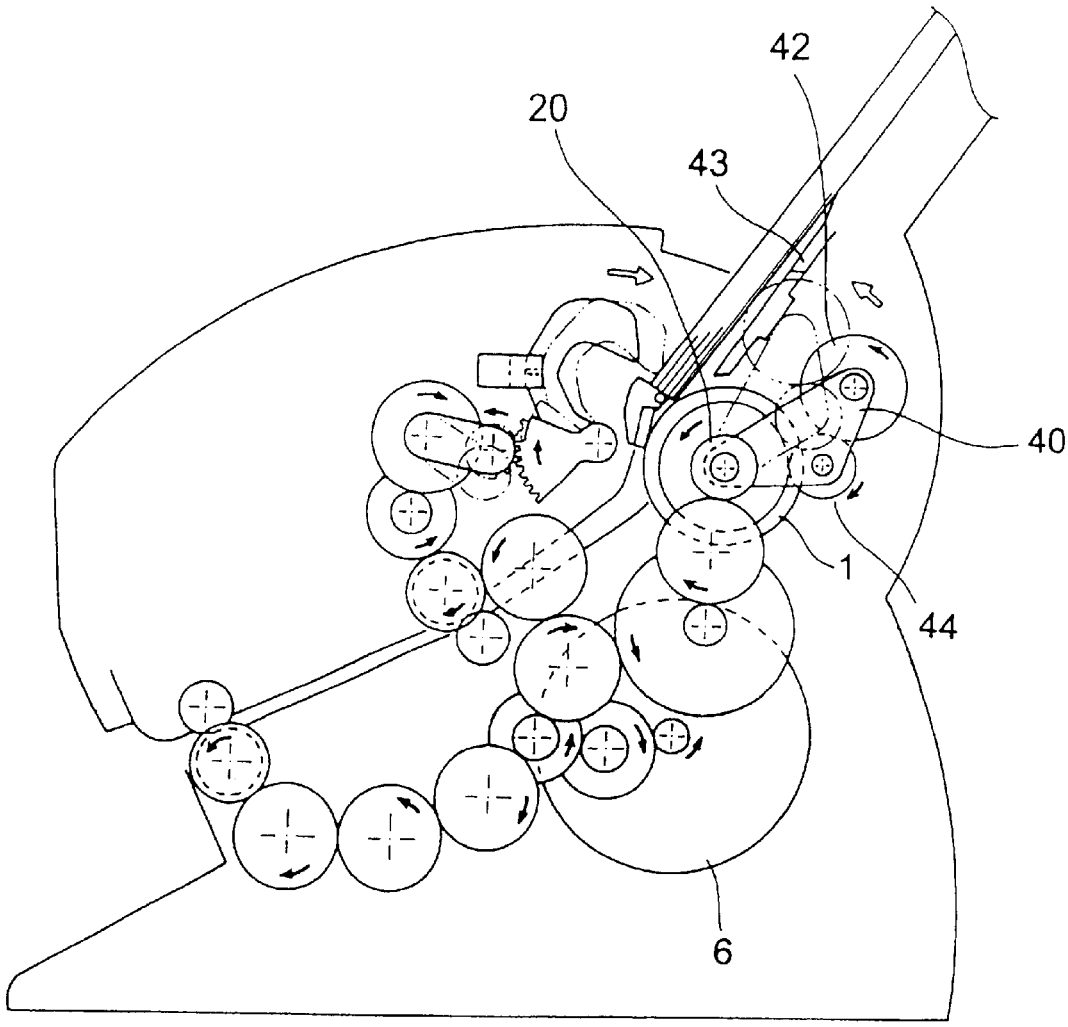

To cope with this, as shown in FIG. 24, there can be a construction where the rotation of the pickup roller driving gear 20 is transmitted to the pre-pickup roller 42 using an idle roller 44 that enables the idling of the pre-pickup roller 42, in place of the idle gear 41. With the embodiment shown in FIG. 24, the use of an idle roller 44 allows the pre-pickup roller 42 to be idled, eliminating the need for a one-way clutch in the pre-pickup roller 42.

Figure 25:
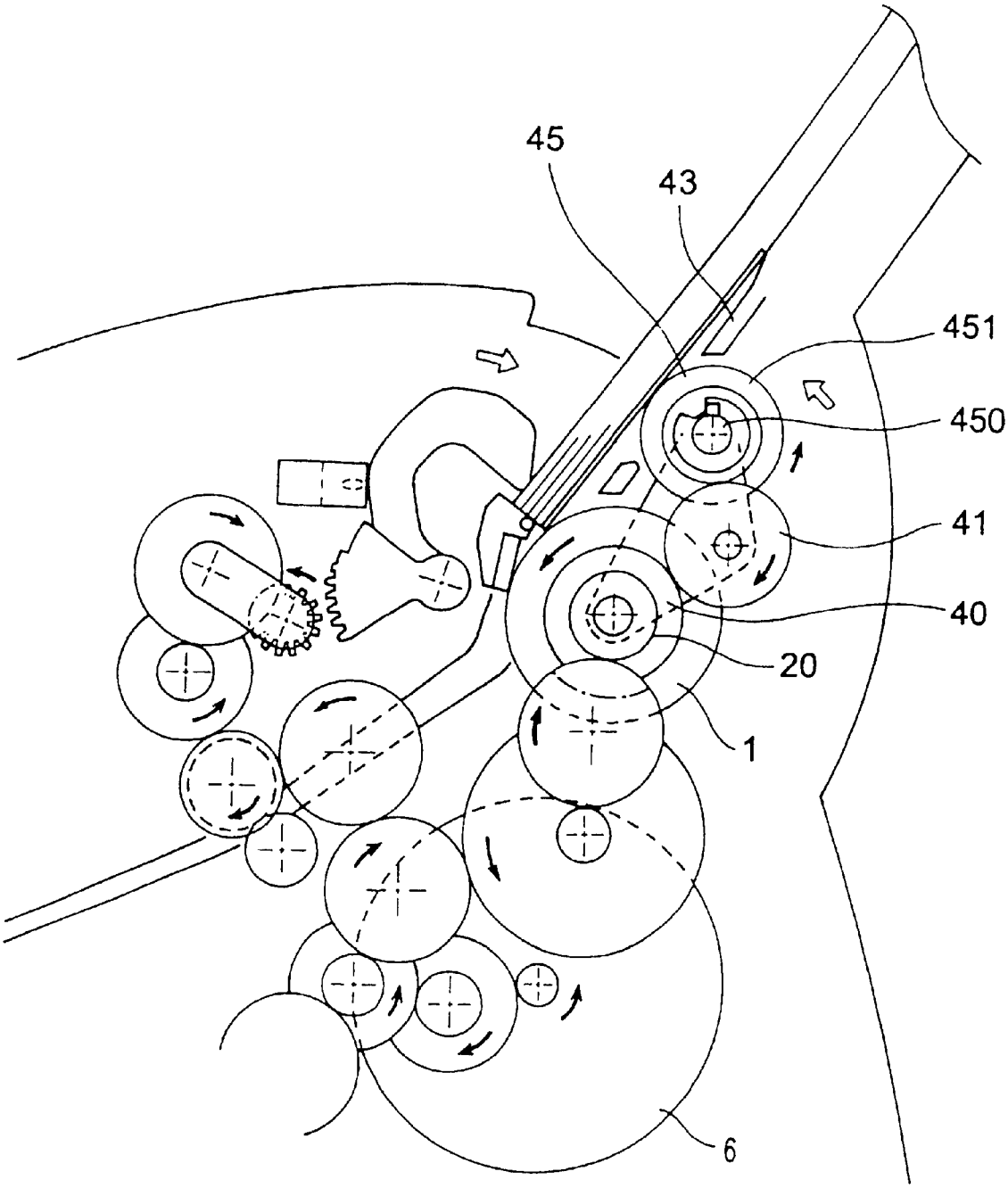

As shown in FIG. 25, a delay roller 45 can be employed as the pre-pickup roller 42. The delay roller 45 has a construction where a pre-pickup roller shaft 450 having a projection rotating together with the rotation of the idle gear 41, and a roller 451 incorporating the pre-pickup roller shaft 450 and having a projection for engaging with the projection of the pre-pickup roller shaft 450. With the embodiment of FIG. 25, the use of the delay roller 45 that can be rotated in only counterclockwise (in the direction of paper feed) eliminates the need for a one-way clutch in the pre-pickup roller 42.

Figure 26:
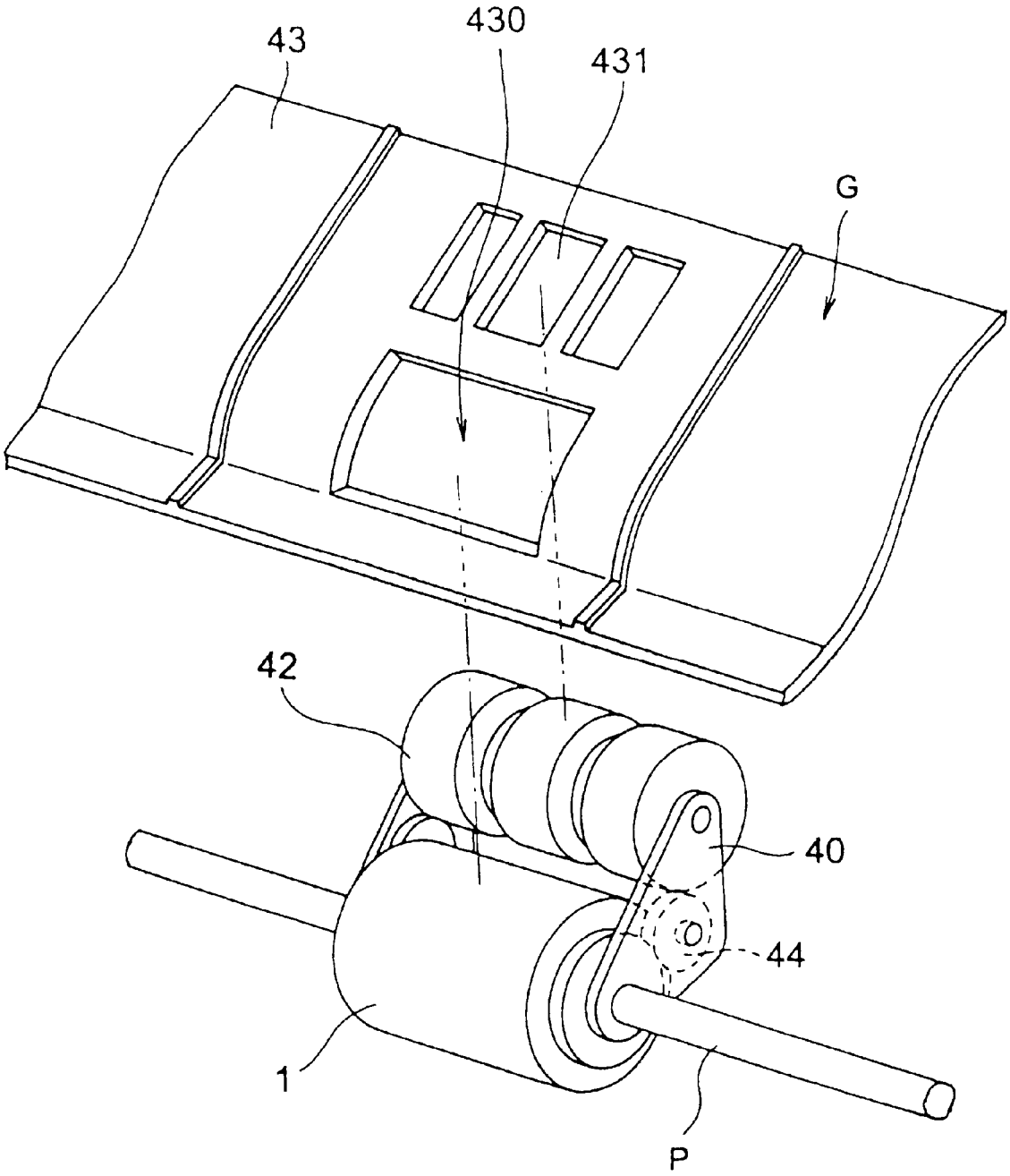
Figure 27:
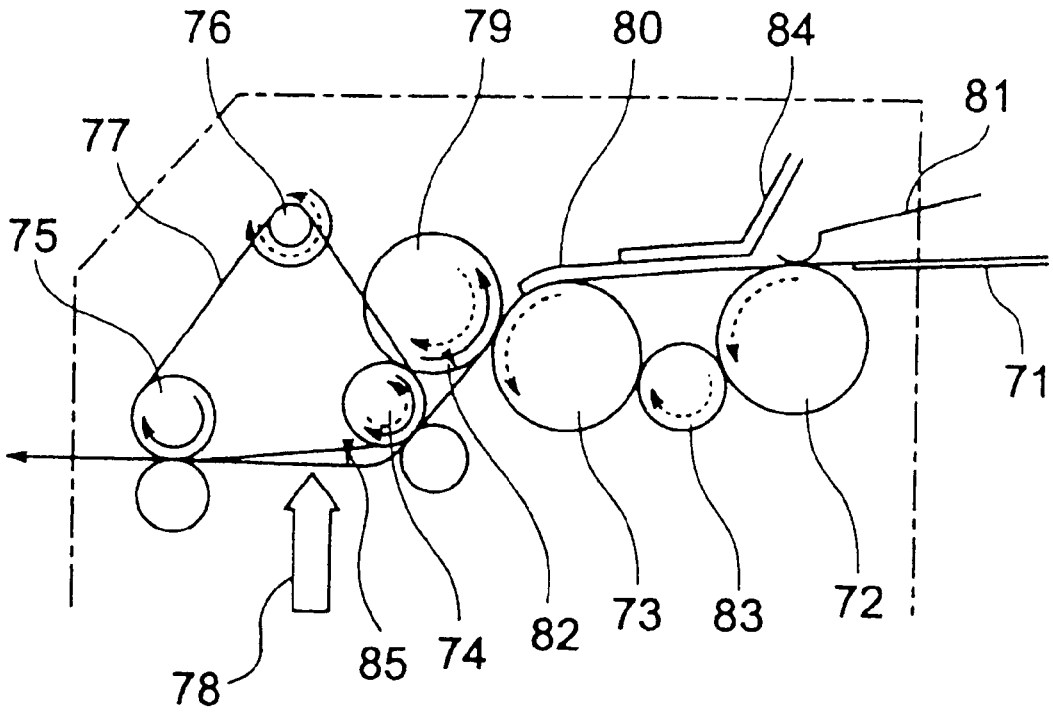
FIGS. 27 through 28 are diagrams of assistance in explaining the prior art.
Figure 28A:
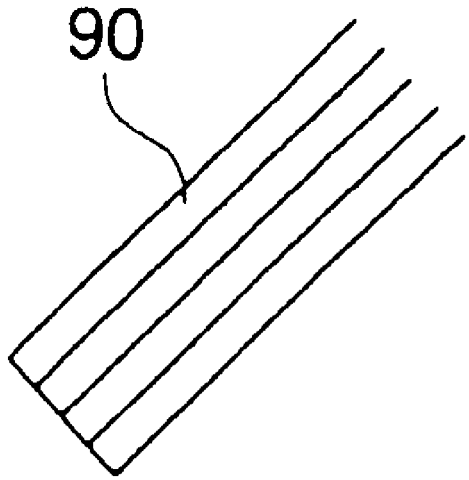
Figure 28B:
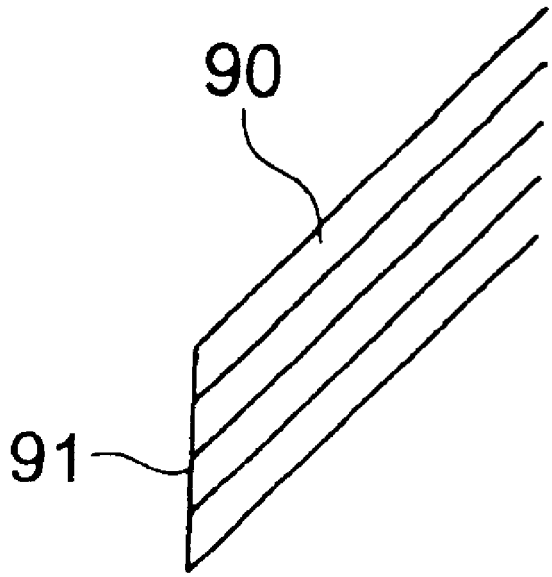

The stopper 43 in the embodiments shown in FIGS. 23, 25 and 26 has an insertion hole 430 for the pickup roller 1, and insertion hole 431 for the pre-pickup roller 42, as shown in FIG. 26. When the pre-pickup unit 40 rotates clockwise, the insertion hole 431 for the pre-pickup roller 42 is left opened. And, symbol G refers to a paper guide, and symbol P to a pickup roller shaft.

In this state, the manuscript 21 stacked on the chute 13 may be caught by any of these insertion holes 431. As shown in FIG. 26, therefore, the insertion hole 431 for the pre-pickup roller 42 should be formed in such a manner that one or a plurality of bridges are provided in the insertion hole 431 in the direction of paper feed, and notches are provided on the pre-pickup roller 42 to clear the bridges.

As described above, the present invention can expect the following beneficial effects.

In a paper feed apparatus having a pickup mechanism to pick up a plurality of sheets of paper stacked on a chute one by one from the bottom, and carrying the paper sheet to a predetermined standby position, the paper feed apparatus can be made compact in size because a gate disposed facing the pickup roller almost vertically with respect to the paper entry direction, a paper-sheet separating pad making sliding contact with the pickup roller to pick up the paper sheets one by one, and a pickup arm that is moved upward when setting paper sheets and moved downward when feeding the paper sheets to push from above the paper sheets stacked on the chute at the paper feeding port are provided, and a plurality of sheets of paper stacked on the chute can be picked up one by one from the bottom and transported to the paper feed path by disposing a pickup roller, and a gate, paper-sheet separating pad and a pickup arm on the pickup roller. Moreover, the paper-sheet separating performance can be improved in the aforementioned embodiment since the gate is provided almost vertically with respect to the paper-sheet entry direction, thereby eliminating vertical component force and multiple-sheet feeding force at the gate. Further, improved pickup performance can help improve operability because the edge aligning operation of forming the leading edge of paper into a knife edge can be eliminated when multiple sheets of paper are set on the chute.

Furthermore, paper-sheet pickup performance can be further improved since the paper feed apparatus of the present invention having the aforementioned construction may have a pre-pickup roller adapted to be driven in such a manner that the pre-pickup roller is moved downward when paper sheets are set, and upward when the paper sheets are fed, so that the paper sheets stacked on the chute can be transported to the gate by pre-picking up the paper sheets from the rear surface while causing the pre-pickup roller to rotate at a peripheral speed lower than the peripheral speed of the pickup roller.

In the paper feed apparatus of the present invention having this construction, the rotating fulcrum of the pickup arm is provided at such a location that the tip of the pickup arm pushes the paper at a location away from the gate as the number of paper sheets stacked on the chute increases. This arrangement helps prevent paper sheets from curling because the pickup arm pushes the paper at a location close to the gate, when a small number of paper sheets are stacked on the chute, and when a large number of paper sheets are stacked on the chute, the rate of successful paper pickup against the user's paper setting can be improved because the paper sheets are pushed by the pickup arm at a location remote from the gate.

Moreover, the paper feed apparatus according to the present invention has a clutch mechanism to drive the pickup arm, using in common the motor for transporting paper sheets as a drive source. In the clutch mechanism, the forward rotation of the motor disengages the planetary gear from a drive power transmission system, causing the pickup arm to move downward, while the reverse rotation of the motor 6 engages the planetary gear with the drive power transmission system, causing the pickup arm to move upward. In this way, a single drive source can perform both paper transport and pickup arm lifting/lowering operations, thereby reducing the number of components and making the paper feed apparatus compact in size.

Further, the pickup arm pushes the paper with a pushing force that increases with increases in the number of paper sheets stacked on the chute when the planetary gear is put in a free state as a result of its disengagement from the drive power transmission system. It follows from this that the pickup arm pushes the paper stack with a small pushing force when the number of paper sheets stacked on the chute is small, and pushes the paper stack with a large force when the number of paper sheets stacked on the chute is large. Thus, the pickup arm can push the paper stack with an optimum force at all times.

Further, the clutch mechanism based on planetary gear train, which has a pickup arm sensor for detecting that the pickup arm is moved upward, also has a function of moving the pickup arm upward until the pickup arm sensor detects the pickup arm. The frame of the planetary gear which operates with frictional forces tends to cause some delays in the operation of the pickup arm. By providing the pickup arm sensor in the planetary gear-based clutch mechanism, the operation of the pickup arm can be accurately detected regardless of some delays in the operation of the pickup arm.

Furthermore, the planetary gear-based clutch mechanism has a cut-tooth portion by removing part of teeth of the pickup arm driving gear by the depth of the addendum circle of the planetary gear, eliminating the pickup arm sensor. This allows the pickup arm to be made compact, the number of teeth of the pickup arm driving gear to be reduced, the number of pulses for the reverse rotation of the motor to be increased. As a result, when teeth of the pickup arm driving gear have to be skipped to prevent the pickup arm from being excessively lifted to cope with few delays in the operation of the pickup arm, the strokes for causing tooth skips can be reduced, and thereby tooth skipping noise (tooth rasping noise) that gives discomfort to the user can be reduced.

Moreover, the paper feed apparatus according to the present invention has a chute-mounted paper-sheet sensor mounted in such a positional relationship that paper sheets can be detected only when paper sheets are set on the chute, and also has a function of not executing the operation of moving the pickup arm upward after the paper feed apparatus has been initialized or reset so long as the chute-mounted papersheet sensor detects the presence of paper sheets. As a result, even when an attempt is made to initialize or reset the paper feed apparatus in the state where paper sheets are set on the chute, paper sheets can be prevented from being taken in the paper feed path.

Moreover, the paper feed apparatus according to the present invention has a paper-sheet sensor between pickup/feed rollers for detecting the presence/absence of paper sheets between the pickup and feed rollers in the paper feed path, and also has a function of jogging the paper stack on the chute by repeating the reverse/forward rotation of the motor when paper sheets are not picked up. As a result, paper-sheet pickup performance can be improved by jogging the paper stack on the chute when paper sheets are not picked up.

Formation of a shouldered portion on the chute by slightly lowering the level of the chute near the paper feed port can make the paper stack cantilevered, reducing the resistance of the paper stack against the pushing force exerted by the pickup arm on the paper stack. This contribute to improved paper-sheet pickup performance since the pushing force exerted by the pickup arm onto the paper stack can be positively transmitted to the pickup roller even with upwardly curled paper sheets.

Furthermore, the gate is integrally formed with the member for mounting the paper-sheet separating pad, with an end of the member having a rotating fulcrum almost in alignment with the tip of the gate. By pushing the other end of the member, therefore, the distance from the gate to the paper-sheet separating pad can be reduced to the minimum. This arrangement helps reduce to the minimum the possible curling of paper edges between the gate and the paper-sheet separating pad. This results in improved paper feeding performance, making it possible to make the gate and the paper-sheet separating pad, and accordingly the entire paper feed apparatus assembly compact in size. Since the rotating fulcrum is in alignment with the tip of the gate, a constant gate gap can be maintained regardless of variations in the thickness of the paper-sheet separating pad and of friction with the paper-sheet separating pad during paper feeding. This leads to stabilized paper feeding performance.

Moreover, by forming the gate by resin molding, and limiting mechanical fixing to a small range by mounting the paper-sheet separating pad on the gate by inserting a pad retaining wire spring near the gate portion, both the gate and the paper-sheet separating pad, and accordingly the paper feed apparatus assembly, can be made compact in size. The paper feed apparatus according to the present invention can bring out stabilized paper-sheet separating performance without the fear of coming off the paper-sheet separating pad. Since the paper-sheet separating pad can be mounted without the need for drying time, compared with the use of adhesive, the entire paper feed apparatus assembly can be assembled in a short period of time.

The method of controlling the paper feed apparatus according to the present invention comprises the steps of starting paper feeding by forward rotating the paper feed motor, based on an instruction to start paper feeding, to disengage the planetary gear from the drive power transmission system, lowering the pickup arm to apply an initial paper transporting pressure to the paper, and reverse rotating the paper feed motor, base on an instruction to terminate paper feeding, to engage the planetary gear with the drive power transmission system to move the pickup arm upward until the pickup arm sensor detects the pickup arm. With this arrangement, paper feeding and paper-sheet pickup operations can be carried out using a single drive source, reducing the number of component parts and making the paper feed apparatus assembly compact in size. The frame of the planetary gear which operates with frictional forces tends to cause some delays in the operation of the pickup arm. By providing the pickup arm sensor in the planetary gear-based clutch mechanism, the operation of the pickup arm can be accurately detected regardless of some delays in the operation of the pickup arm.

The method of controlling the paper feed apparatus according to the present invention comprises the steps of lowering the pickup arm by temporarily forward rotating the paper feed motor when the pickup arm is lifted after the paper feed apparatus has been initiated or reset, and lifting the pickup arm by reverse rotating the motor after carrying out the operation of lowering the pickup arm. With the paper feed apparatus having not means for detecting the operation of the pickup arm, the function of preventing the pickup arm from being excessively lifted must be provided to make the pickup arm compact. With the aforementioned arrangement, tooth skipping noise (tooth rasping noise) can be eliminated even when no pickup arm sensor is provided.

Furthermore, when carrying out the operation of lifting the pickup arm after the paper feed apparatus has been initialized or reset, the operation of lifting the pickup arm is not carried out in the state where the chute-mounted paper-sheet sensor installed in such a positional relationship that the sensor detects paper sheets only when the paper sheets are set on the chute in the state where the pickup arm is moved upward detects the paper sheets. This arrangement prevents the paper stack on the chute from being taken in the paper feed path even when an attempt is made to initialize or reset the paper feed apparatus in the state where the paper sheets are set on the chute.

The method of controlling the paper feed apparatus according to the present invention comprises the steps of detecting the presence/absence of paper sheets between the pickup and feed rollers in the paper feed path during paper feeding, and executing the operation of jogging the paper stack on the chute by the pickup arm by repeating the reverse/forward rotation of the motor when paper sheets are not detected between the pickup and feed rollers in the paper feed path. With this arrangement, paper-sheet pickup performance can be improved by detecting whether a paper sheet is picked up, and carrying out the operation of jogging the paper stack on the chute, if no paper sheet is detected.

Since the recording medium for storing programs for implementing the control of the paper feed apparatus according to the present invention can be implemented using programs for operating the computer, and the programs can be stored in various adequate types of recording media, including FDD and CD, they can be installed in any processing devices as necessary to execute processing.

Industrial Applicability

The paper feed apparatus according to the present invention is capable of making the entire assembly compact in size, improving :paper-sheet separating performance, eliminating the need for the operation of aligning paper sheets when multiple sheets of paper are set on the chute, and properly feeding paper sheets by pushing the paper stack with an optimum pushing force.

What is claimed is:

1. A paper feed apparatus having a paper-sheet pickup mechanism to pick up a plurality of paper sheets stacked on a chute one by one from the bottom and carrying the paper sheets to a predetermined standby position, the apparatus comprising:

a gate disposed facing a pickup roller almost vertically with respect to the direction of paper feed to form a predetermined clearance;

a paper-sheet separating pad disposed in sliding contact with the pickup roller to pick up the paper placed on the standby position one by one; and a pickup arm that can be driven to be moved upward when setting paper sheets and downward when feeding paper sheets to push from above the paper sheets stacked on a chute near a paper-sheet feed port;

wherein the pickup arm is driven by a clutch mechanism using a planetary gear and a paper feed motor that is used in common as a drive source in such a manner that the pickup arm is moved downward as the forward rotation of the motor disengages the planetary gear from a drive power transmission system, and upward as the reverse rotation of the motor engages the planetary gear with the drive power transmission system; and wherein, in a case that the pickup arm brought into free state as the planetary gear disengages from the drive power transmission system, the pickup arm pushes paper sheets with a pushing force that increases with increases in the number of paper sheets stacked on the chute.

2. A paper feed apparatus having a paper-sheet pickup mechanism to pick up a plurality of paper sheets stacked on a chute one by one from the bottom and carrying the paper sheets to a predetermined standby position, the apparatus comprising:

a gate disposed facing a pickup roller almost vertically with respect to the direction of paper feed to form a predetermined clearance;

a paper-sheet separating pad disposed in sliding contact with the pickup roller to pick up the paper placed on the standby position one by one; and a pickup arm that can be driven to be moved upward when setting paper sheets and downward when feeding paper sheets to push from above the paper sheets stacked on a chute near a paper-sheet feed port;

wherein a rotating fulcrum of the pickup arm is provided at such a location that the tip of the pickup arm pushes paper sheets at a location away from the gate as the number of paper sheets stacked on the chute increases.

3. A paper feed apparatus having a paper-sheet pickup mechanism to pick up a plurality of paper sheets stacked on a chute one by one from the bottom and carrying the paper sheets to a predetermined standby position, the apparatus comprising:

a gate disposed facing a pickup roller almost vertically with respect to the direction of paper feed to form a predetermined clearance;

a paper-sheet separating pad disposed in sliding contact with the pickup roller to pick up the paper placed on the standby position one by one; and a pickup arm that can be driven to be moved upward when setting paper sheets and downward when feeding paper sheets to push from above the paper sheets stacked on a chute near a paper-sheet feed port;

wherein a paper-sheet retaining member having such a shape as to hold down the upward warping of paper sheets stacked on the chute is provided at the tip of the pickup arm.

4. A paper feed apparatus having a paper-sheet pickup mechanism to pick up a plurality of paper sheets stacked on a chute one by one from the bottom and carrying the paper sheets to a predetermined standby position, the apparatus comprising:

a gate disposed facing a pickup roller almost vertically with respect to the direction of paper feed to form a predetermined clearance;

a paper-sheet separating pad disposed in sliding contact with the pickup roller to pick up the paper placed on the standby position one by one; and a pickup arm that can be driven to be moved upward when setting paper sheets and downward when feeding paper sheets to push from above the paper sheets stacked on a chute near a paper-sheet feed port;

wherein a pre-pickup roller that can be driven in such a manner as to be moved upward when setting paper sheets and downward when feeding paper sheets, rotating at a peripheral speed lower than the peripheral speed of the pickup roller so as to pre-pick up paper sheets stacked on the chute to transport to the gate is provided.

5. A paper feed apparatus according to claim 4 wherein the pre-pickup roller is rotated by a gear which transmits the rotation of a paper feed motor and has a mechanism that can rotate only in a direction of paper feed.

6. A paper feed apparatus according to claim 4 wherein the pre-pickup roller is rotated by a roller which transmits the rotation of a paper feed motor.

7. A paper feed apparatus according to claim 4 further comprising:

a stopper having an opening with one or a plurality of bridges that match with notches on the pre-pickup roller, and making the pre-pickup roller stop at a pre-pickup position.

* * * * *

UNITED STATES PATENT AND TRADEMARK OFFICE

CERTIFICATE OF CORRECTION

PATENT NO. : 6,540,219 B1
DATED : April 1, 2003
INVENTOR(S) : Satoshi Ishida et al.

It is certified that error appears in the above-identified patent and that said Letters Patent is hereby corrected as shown below:

Title page,
Item [75], Inventors, change "Akira Naruse; Kouichi Kumon; Mitsurus Sato; all of Kawasaki, Japan" to -- Satoshi Ishida, Kanazawa; and Yohiki Tsuchiyama, Komatsu, both of Japan. --

Signed and Sealed this

First Day of June, 2004

JON W. DUDAS
*Acting Director of the United States Patent and Trademark Office*